US009822988B2

(12) United States Patent
Ito et al.

(10) Patent No.: US 9,822,988 B2
(45) Date of Patent: Nov. 21, 2017

(54) DEHUMIDIFYING APPARATUS

(71) Applicant: Mitsubishi Electric Corporation, Tokyo (JP)

(72) Inventors: Shinichi Ito, Tokyo (JP); Fumitake Unezaki, Tokyo (JP); Mamoru Hamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/781,926

(22) PCT Filed: Apr. 10, 2013

(86) PCT No.: PCT/JP2013/060776
§ 371 (c)(1),
(2) Date: Oct. 2, 2015

(87) PCT Pub. No.: WO2014/167660
PCT Pub. Date: Oct. 16, 2014

(65) Prior Publication Data

US 2016/0061461 A1 Mar. 3, 2016

(51) Int. Cl.
*F24F 3/14* (2006.01)
*F25D 21/12* (2006.01)
*F24F 11/00* (2006.01)

(52) U.S. Cl.
CPC ..... *F24F 3/1429* (2013.01); *F24F 3/1405* (2013.01); *F25D 21/12* (2013.01); *F24F 2003/144* (2013.01); *F24F 2003/1458* (2013.01); *F24F 2011/0087* (2013.01)

(58) Field of Classification Search
CPC ..... F25B 30/00; F25B 15/00; F25B 30/06; F25B 13/00; F25B 47/02; F24F 3/1405; F24F 3/1429; F24F 2003/144; F24F 2003/1458; F24F 2011/0087; F24F 3/14; F25D 21/12; F25D 21/00; F25D 21/04; Y02B 30/62; Y02B 30/64
USPC ..... 62/94, 271, 272, 277, 324.1
See application file for complete search history.

(56) References Cited

U.S. PATENT DOCUMENTS 4,269,611 A * 5/1981 Anderberg ..... B01D 53/261 96/124
4,700,550 A * 10/1987 Rhodes ..... B01D 53/26 62/271
7,437,884 B2 * 10/2008 Otake ..... F24F 3/1423 62/271

(Continued)

FOREIGN PATENT DOCUMENTS

JP 2000-171058 A 6/2000
JP 2002-224530 A 8/2002

(Continued)

OTHER PUBLICATIONS

International Search Report of the International Searching Authority dated Jul. 2, 2013 for the corresponding international application No. PCT/JP2013/060776 (and English translation).

(Continued)

*Primary Examiner* — Mohammad M Ali
(74) *Attorney, Agent, or Firm* — Posz Law Group, PLC

(57) ABSTRACT

A dehumidifying apparatus controls the amount of refrigerant flowing into a third heat exchanger serving as a condenser, so as to secure the amount of heat required for defrosting.

15 Claims, 10 Drawing Sheets

(56) References Cited

U.S. PATENT DOCUMENTS

2003/0136140 A1* 7/2003 Maeda ..... F24F 3/1405 62/271
2005/0150237 A1* 7/2005 Yabu ..... F24F 3/1411 62/94
2006/0201183 A1* 9/2006 Otake ..... F24F 3/1423 62/271
2007/0125115 A1* 6/2007 Matsui ..... B01D 53/261 62/331
2008/0265045 A1* 10/2008 Yabu ..... F24F 3/065 236/44 C
2010/0022177 A1* 1/2010 Hidaka ..... B60H 1/00478 454/156
2011/0056220 A1* 3/2011 Caggiano ..... B01D 53/002 62/94
2011/0280736 A1* 11/2011 Lee ..... D06F 58/206 417/26

FOREIGN PATENT DOCUMENTS

JP 2003-227626 A 8/2003
JP 2006-336971 A 12/2006
JP 2008-148832 A 7/2008
JP 2008-170137 A 7/2008
JP 4649967 B2 3/2011

OTHER PUBLICATIONS

Extended European Search Report dated Dec. 19, 2016 issued in corresponding EP patent application No. 13881922.2.
Office Action dated Mar. 21, 2017 issued in corresponding CN patent application No. 201380075437.5 (with English translation).

* cited by examiner (a) (b)

(a)

(b)

DEHUMIDIFYING APPARATUS

CROSS REFERENCE TO RELATED APPLICATION

This application is a U.S. national stage application of International Application No. PCT/JP2013/060776 filed on Apr. 10, 2013, the disclosure of which is incorporated herein by reference.

TECHNICAL FIELD

The present invention relates to a dehumidifying apparatus that combines a desiccant with a heat pump.

BACKGROUND ART

Conventionally, there have been dehumidifying apparatuses that combine a desiccant for adsorbing and desorbing moisture with a heat pump. For example, a dehumidifying apparatus is proposed, which defines an air passage to allow air currents of different relative humidities to pass through a rotor-like desiccant material and rotates the desiccant material to repeat an adsorption reaction and a desorption reaction (see, e.g., Patent Literature 1). At a low temperature (e.g., 10 degrees C.), the dehumidifying apparatus described in Patent Literature 1 causes air heated by a heater to flow into the desiccant material to promote transmission of moisture. This increases the humidity and the amount of humidification, so that passage of the heated air through an evaporator raises the evaporation temperature and suppresses frost formation on a heat exchanger.

CITATION LIST

Patent Literature

Patent Literature 1: Japanese Patent No. 4649967 (e.g., claims 1 and 6)

SUMMARY OF INVENTION

Technical Problem

The dehumidifying apparatus described in Patent Literature 1 is capable of suppressing frost formation. However, at a lower temperature (e.g., 5 degrees C.), a lack of heater performance causes low-temperature air to flow into the evaporator. This results in frost formation at such a low outside temperature.

In the case of frost formation, the dehumidifying apparatus described in Patent Literature 1 requires defrosting by heating with the heater, or defrosting through an off-cycle process with a compressor being at rest. However, defrosting using the heater increases power consumption and humidifies ambient air during the defrosting. In the case of defrosting through an off-cycle process, it takes a long time to complete the defrosting, and a sufficient amount of dehumidification cannot be achieved in a low temperature range due to humidification of air passing through the evaporator.

Although condensation heat is generated in the refrigeration cycle, most of the condensation heat is released without being used; that is, a heat source available for defrosting cannot be used in the technique described in Patent Literature 1.

The present invention has been made to solve at least one of the problems described above. An object of the present invention is to provide a dehumidifying apparatus that can perform defrosting using condensation heat in the refrigeration cycle, and can minimize the time required to discharge humidified air during the defrosting. Another object of the present invention is to provide a dehumidifying apparatus that can control the quality of air flowing into a desiccant material to be suitable for defrosting and dehumidification.

Solution to Problem

A dehumidifying apparatus according to the present invention includes an air passage housing having an air inlet and an air outlet, a first heat exchanger disposed in the air passage housing, a second heat exchanger disposed in the air passage housing, a third heat exchanger disposed in the air passage housing, a moisture adsorbing unit disposed between the first heat exchanger and the second heat exchanger in the air passage housing to desorb moisture to air with a low relative humidity and adsorb moisture from air with a high relative humidity, an air sending device configured to send air to the first heat exchanger, the moisture adsorbing unit, the second heat exchanger, and the third heat exchanger in this order, a compressor configured to compress a refrigerant, a bypass configured to allow the refrigerant discharged from the compressor configured to partially or entirely bypass the third heat exchanger, a flow control device for controlling a flow rate of the refrigerant flowing through the bypass, a refrigerant circuit switching device for allowing the first heat exchanger and the second heat exchanger to serve as a condenser and an evaporator, respectively, or allowing the first heat exchanger and the second heat exchanger to serve as an evaporator and a condenser, respectively, and an expansion device for reducing a pressure of the refrigerant condensed by one of the first heat exchanger and the second heat exchanger. The refrigerant circuit switching device switches between a first refrigerant flow passage in which the refrigerant circulates through the compressor, the third heat exchanger, the second heat exchanger, the expansion device, and the first heat exchanger in this order and a second refrigerant flow passage in which the refrigerant circulates through the compressor, the third heat exchanger, the first heat exchanger, the expansion device, and the second heat exchanger in this order. The flow control device controls a flow rate of the refrigerant flowing through the bypass, and controls an amount of heating in the third heat exchanger.

Another dehumidifying apparatus according to the present invention includes an air passage housing having an air inlet and an air outlet, a first heat exchanger disposed in the air passage housing, a second heat exchanger disposed in the air passage housing, a third heat exchanger disposed in the air passage housing, a moisture adsorbing unit disposed between the first heat exchanger and the second heat exchanger in the air passage housing to desorb moisture to air with a low relative humidity and adsorb moisture from air with a high relative humidity, an air sending device configured to send air to the first heat exchanger, the moisture adsorbing unit, the second heat exchanger, and the third heat exchanger in this order, an air passage switching device to switch a flow of air sent by the air sending device, a compressor configured to compress a refrigerant, a bypass configured to allow the refrigerant discharged from the compressor configured to partially or entirely bypass the third heat exchanger, a flow control device for controlling a flow rate of the refrigerant flowing through the bypass, a refrigerant circuit switching device for allowing the first heat exchanger and the second heat exchanger to serve as a condenser and an evaporator, respectively, or allowing the first heat exchanger and the second heat exchanger to serve as an evaporator and a condenser, respectively, and an expansion device for reducing a pressure of the refrigerant condensed by one of the first heat exchanger and the second heat exchanger. The refrigerant circuit switching device switches between a first refrigerant flow passage in which the refrigerant circulates through the compressor, the third heat exchanger, the second heat exchanger, the expansion device, and the first heat exchanger in this order and a second refrigerant flow passage in which the refrigerant circulates through the compressor, the third heat exchanger, the first heat exchanger, the expansion device, and the second heat exchanger in this order. The air sending device and the air passage switching device control a volume of air passing through the third heat exchanger and control an amount of heating in the third heat exchanger.

Another dehumidifying apparatus according to the present invention includes an air passage housing having an air inlet and an air outlet, a first heat exchanger disposed in the air passage housing, a second heat exchanger disposed in the air passage housing, a third heat exchanger disposed in the air passage housing, a moisture adsorbing unit disposed between the first heat exchanger and the second heat exchanger in the air passage housing to desorb moisture to air with a low relative humidity and adsorb moisture from air with a high relative humidity, an air sending device configured to send air to the first heat exchanger, the moisture adsorbing unit, the second heat exchanger, and the third heat exchanger in this order, a compressor configured to compress a refrigerant, a flow control device for controlling a flow rate of the refrigerant discharged from the compressor and flowing through the third heat exchanger, a first refrigerant circuit switching device for allowing the first heat exchanger and the second heat exchanger to serve as a condenser and an evaporator, respectively, or allowing the first heat exchanger and the second heat exchanger to serve as an evaporator and a condenser, respectively, a first refrigerant circuit switching device for allowing the refrigerant flowing out of the third heat exchanger to flow into the first heat exchanger or the second heat exchanger, and an expansion device for reducing a pressure of the refrigerant condensed by one of the first heat exchanger and the second heat exchanger. The first refrigerant circuit switching device and the second a refrigerant circuit switching device allow the third heat exchanger to be connected in parallel with the first heat exchanger or the second heat exchanger, and switch between a first refrigerant circuit in which the refrigerant circulates through the compressor, the third heat exchanger, the second heat exchanger, the expansion device, and the first heat exchanger in this order and a second refrigerant circuit in which the refrigerant circulates through the compressor, the third heat exchanger, the first heat exchanger, the expansion device, and the second heat exchanger in this order. The flow control device controls an amount of heating in the third heat exchanger.

Another dehumidifying apparatus according to the present invention includes a first air passage housing having an air inlet and an air outlet, a second air passage housing having an air inlet and an air outlet, a first heat exchanger disposed in the first air passage housing, a second heat exchanger disposed in the first air passage housing, a third heat exchanger disposed in the second air passage housing, a moisture adsorbing unit disposed between the first heat exchanger and the second heat exchanger in the first air passage housing to desorb moisture to air with a low relative humidity and adsorb moisture from air with a high relative humidity, first an air sending device configured to send air to the first heat exchanger, the moisture adsorbing unit, and the second heat exchanger in this order, second an air sending device configured to send air to the third heat exchanger, a compressor configured to compress a refrigerant, a bypass configured to allow the refrigerant discharged from the compressor configured to partially or entirely bypass the third heat exchanger, a flow control device for controlling a flow rate of the refrigerant flowing through the bypass, a refrigerant circuit switching device for allowing the first heat exchanger and the second heat exchanger to serve as a condenser and an evaporator, respectively, or allowing the first heat exchanger and the second heat exchanger to serve as an evaporator and a condenser, respectively, and an expansion device for reducing a pressure of the refrigerant condensed by one of the first heat exchanger and the second heat exchanger. The refrigerant circuit switching device switches between a first refrigerant flow passage in which the refrigerant circulates through the compressor, the third heat exchanger, the second heat exchanger, the expansion device, and the first heat exchanger in this order and a second refrigerant flow passage in which the refrigerant circulates through the compressor, the third heat exchanger, the first heat exchanger, the expansion device, and the second heat exchanger in this order. The flow control device controls a flow rate of the refrigerant flowing through the bypass, and controls an amount of heating in the third heat exchanger.

Advantageous Effects of Invention

The dehumidifying apparatus according to the present invention is capable of controlling the amount of heating in the first heat exchanger, the second heat exchanger, and the third heat exchanger. Particularly when, for example, the amount of heat required for desorption of the moisture adsorbing unit differs from that required for defrosting of a heat exchanger, the dehumidifying apparatus can supply an appropriate amount of heat for the intended purpose, reduce the time required for defrosting, and control the amount of moisture desorbed from the moisture adsorbing unit.

DESCRIPTION OF EMBODIMENTS

Figure 1:
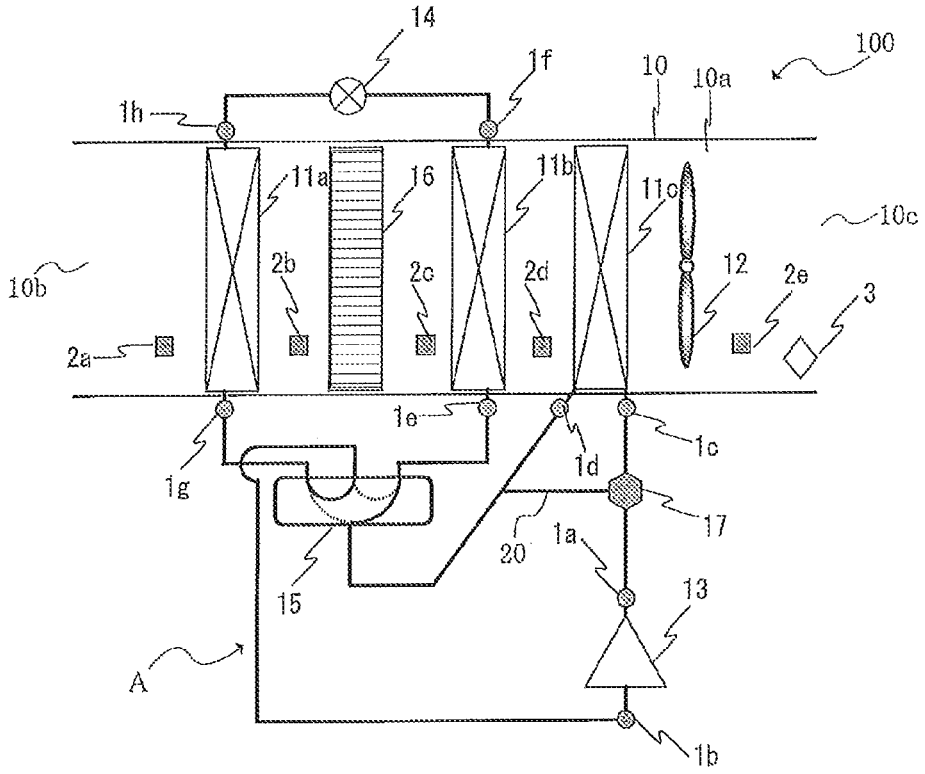
FIG. 1 is a schematic diagram illustrating an exemplary general configuration of a dehumidifying apparatus according to Embodiment 1 of the present invention.

Embodiments of the present invention will now be described with reference to the drawings. In the following drawings including FIG. 1, the dimensional relationships among components may differ from those among actual components. Also in the following drawings including FIG. 1, the same or corresponding components are denoted by the same reference numerals, and this is applicable throughout the description. The forms of component parts shown throughout the description are merely examples, and are not limited to their description.

Embodiment 1

Figure 2:
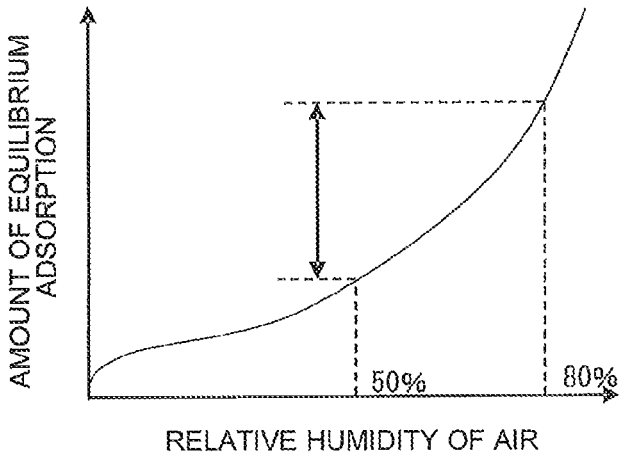
FIG. 2 is an adsorption isotherm diagram showing the amount of saturated moisture adsorption of a moisture adsorbing unit of the dehumidifying apparatus according to Embodiment 1 of the present invention, with respect to relative humidity.

FIG. 1 is a schematic diagram illustrating an exemplary general configuration of a dehumidifying apparatus 100 according to Embodiment 1 of the present invention. FIG. 2 is an adsorption isotherm diagram showing the amount of adsorption of saturated moisture adsorption of a moisture adsorbing unit 16 of the dehumidifying apparatus 100 with respect to relative humidity. The dehumidifying apparatus 100 will be described with reference to FIGS. 1 and 2.

<Configuration of Airflow Passage (Air Passage) in Dehumidifying Apparatus 100>

Air to be dehumidified in the dehumidifying apparatus 100 passes through a first heat exchanger 11*a*, the moisture adsorbing unit 16, a second heat exchanger 11*b*, and a third heat exchanger 11*c* and is discharged by an air sending device 12 to a space to be dehumidified.

The dehumidifying apparatus 100 includes an air passage housing 10 in which an airflow passage 10*a* is formed. The airflow passage 10*a* is a passage along which air is flowed by the air sending device 12 through the first heat exchanger 11*a*, the moisture adsorbing unit 16, the second heat exchanger 11*b*, and the third heat exchanger 11*c*. The air passage housing 10 has an air inlet 10*b* for introducing air, and an air outlet 10*c* for discharging air.

In FIG. 1, the air sending device 12 is disposed at the most downstream position of the airflow passage 10*a* in the air passage housing 10. However, the air sending device 12 may be disposed at the most upstream position of the airflow passage 10*a*, as long as a target volume of air passes through the first to third heat exchangers 11*a* to 11*c* and the moisture adsorbing unit 16. That is, the position of the air sending device 12 is not limited to that shown in the drawing.

Sensors arranged in the airflow passage 10*a* will be described.

Temperature and humidity sensors 2*a* to 2*e* are configured to detect one of the dry-bulb temperature, relative humidity, dew-point temperature, absolute humidity, and wet-bulb temperature, in the airflow passage 10*a*.

The temperature and humidity sensor 2*a* is disposed at an entrance of the airflow passage 10*a* of the dehumidifying apparatus 100, and configured to detect the temperature and humidity of air to be dehumidified.

The temperature and humidity sensor 2*b* is disposed on the downstream side of the first heat exchanger 11*a* in the airflow, and configured to detect the temperature and humidity of air that has passed through the first heat exchanger 11*a*.

The temperature and humidity sensor 2*c* is disposed on the downstream side of the moisture adsorbing unit 16 in the airflow, and configured to detect the temperature and humidity of air that has passed through the moisture adsorbing unit 16.

The temperature and humidity sensor 2*d* is disposed on the downstream side of the second heat exchanger 11*b* in the airflow, and configured to detect the temperature and humidity of air that has passed through the second heat exchanger 11*b*.

The temperature and humidity sensor 2*e* is disposed on the downstream side of the third heat exchanger 11*c* in the airflow, and configured to detect the temperature and humidity of air that has passed through the third heat exchanger 11*c*.

An air speed sensor (air volume detector) 3 is disposed in the airflow passage 10*a*.

The air speed sensor 3 is configured to detect the volume of air passing in the airflow passage 10*a*. The air speed sensor 3 may be disposed at any position as long as it can detect the volume of air passing in the airflow passage 10*a*. That is, the position of the air speed sensor 3 is not particularly limited.

<Configuration of Refrigerant Circuit in Dehumidifying Apparatus 100>

The dehumidifying apparatus 100 includes a refrigerant circuit A. The refrigerant circuit A includes a compressor 13 configured to compress a refrigerant, the first to third heat exchangers 11*a* to 11*c* each serving either as a condenser that condenses the refrigerant or as an evaporator that evaporates the refrigerant, an expansion device 14 for reducing the pressure of the condensed refrigerant, a four-way valve 15 configured to reverse the flow of the refrigerant in the first heat exchanger 11*a* and the second heat exchanger 11*b*, and a flow control device 17 for controlling the flow rate of the refrigerant. These components are connected by pipes to form the refrigerant circuit A.

The dehumidifying apparatus 100 provides four operation modes by switching the four-way valve 15 and the flow control device 17.

In a first operation mode, the four-way valve 15 is switched to connect the third heat exchanger 11*c* to the second heat exchanger 11*b*, and the flow control device 17 is switched to allow the refrigerant discharged from the compressor 13 to flow into the third heat exchanger 11*c*.

That is, in the first operation mode, a refrigerant flow passage (see a refrigerant flow passage 101 illustrated in FIG. 3 described below) configured to allow the refrigerant to flow through the compressor 13, the third heat exchanger 11*c*, the four-way valve 15, the second heat exchanger 11*b*, the expansion device 14, the first heat exchanger 11*a*, and the four-way valve 15 in this order is formed, in which the refrigerant flows into the compressor 13 again.

Note that the flow control device 17 functions here to block the refrigerant from flowing through a flow passage (bypass 20) that bypasses the third heat exchanger 11*c*.

In a second operation mode, the four-way valve 15 is switched to connect the third heat exchanger 11*c* to the first heat exchanger 11*a*, and the flow control device 17 is switched to allow the refrigerant discharged from the compressor 13 to flow into both the third heat exchanger 11*c* and the four-way valve 15.

That is, in the second operation mode, a refrigerant flow passage (see a refrigerant flow passage 102*a* illustrated in FIG. 4(*a*) described below) configured to allow the refrigerant to flow through the compressor 13, the third heat exchanger 11*c*, the four-way valve 15, the first heat exchanger 11*a*, the expansion device 14, the second heat exchanger 11*b*, the four-way valve 15 in this order is formed, in which the refrigerant flows into the compressor 13 again.

At the same time, in the second operation mode, a refrigerant flow passage (see a refrigerant flow passage 102*b* illustrated in FIG. 4(*b*) described below) configured to allow the refrigerant to flow through the compressor 13, the four-way valve 15, the first heat exchanger 11*a*, the expansion device 14, the second heat exchanger 11*b*, and the four-way valve 15 in this order is formed, in which the refrigerant flows into the compressor 13 again.

Note that the flow control device 17 functions here to allow the refrigerant to also flow through a flow passage that bypasses the third heat exchanger 11*c*.

In a third operation mode, the four-way valve 15 is switched to connect the third heat exchanger 11*c* to the first heat exchanger 11*a*, and the flow control device 17 is switched to allow the refrigerant discharged from the compressor 13 to flow into the third heat exchanger 11*c*.

That is, in the third operation mode, a refrigerant flow passage (see a refrigerant flow passage 103 illustrated in FIG. 5 described below) configured to allow the refrigerant to flow through the compressor 13, the third heat exchanger 11*c*, the four-way valve 15, the first heat exchanger 11*a*, the expansion device 14, the second heat exchanger 11*b*, and the four-way valve 15 in this order is formed, in which the refrigerant flows into the compressor 13 again.

Note that the flow control device 17 functions here to block the refrigerant from flowing through a flow passage that bypasses the third heat exchanger 11*c*.

In a fourth operation mode, the four-way valve 15 is switched to connect the third heat exchanger 11*c* to the second heat exchanger 11*b*, and the flow control device 17 is switched to allow the refrigerant discharged from the compressor 13 to flow into both the third heat exchanger 11*c* and the four-way valve 15.

That is, in the fourth operation mode, a refrigerant flow passage (see a refrigerant flow passage 104*a* illustrated in FIG. 6(*a*) described below) configured to allow the refrigerant to flow through the compressor 13, the third heat exchanger 11*c*, the four-way valve 15, the second heat exchanger 11*b*, the expansion device 14, the first heat exchanger 11*a*, and the four-way valve 15 in this order is formed, in which the refrigerant flows into the compressor 13 again.

At the same time, in the fourth operation mode, a refrigerant flow passage (see a refrigerant flow passage 104*b* illustrated in FIG. 4(*b*) described below) configured to allow the refrigerant to flow through the compressor 13, the four-way valve 15, the second heat exchanger 11*b*, the expansion device 14, the first heat exchanger 11*a*, and the four-way valve 15 in this order is formed, in which the refrigerant flows into the compressor 13 again.

Note that the flow control device 17 functions here to allow the refrigerant to also flow through a flow passage that bypasses the third heat exchanger 11*c*.

(Compressor 13)

The compressor 13 is a positive-displacement compressor driven by a motor (not shown). More than one compressor 13 may be mounted. That is, two or more compressors connected in series or parallel may be mounted.

(First to Third Heat Exchangers 11*a* to 11*c*)

The first to third heat exchangers 11*a* to 11*c* are each a cross-fin type fin-and-tube heat exchanger formed by a heat transfer tube and many fins. The refrigerant pipes of the first to third heat exchangers 11*a* to 11*c* may be connected either in series or parallel, as long as it is possible to switch between heating and cooling and control the amount of heating.

(An Air Sending Device 12)

The air sending device 12 is formed by a fan capable of varying the flow rate of air passing through the airflow passage 10*a* of the dehumidifying apparatus 100. For example, the air sending device 12 may be formed by a centrifugal fan or a multi-blade fan driven by a motor, such as a DC fan motor.

(An Expansion Device 14)

The expansion device 14 is capable, for example, of controlling the flow rate of the refrigerant flowing in the refrigerant circuit A. For example, the expansion device 14 may be formed by an electronic expansion valve whose opening degree can be controlled by a stepping motor (not shown), a mechanical expansion valve having a diaphragm serving as a pressure receiver, or a capillary tube.

(Four-Way Valve 15)

The four-way valve 15 is a valve for switching the direction of the refrigerant flowing through the first heat exchanger 11*a* and the second heat exchanger 11*b*. The four-way valve 15 corresponds to "a (first) refrigerant circuit switching device" of the present invention.

In an operation in the first or third operation mode, the four-way valve 15 forms a refrigerant circuit in which the refrigerant that has flowed into the four-way valve 15 passes through the second heat exchanger 11*b*, the expansion device 14, the first heat exchanger 11*a*, and the four-way valve 15 in this order.

In an operation in the second or fourth operation mode, the four-way valve 15 forms a refrigerant circuit in which the refrigerant that has flowed into the four-way valve 15 passes through the first heat exchanger 11*a*, the expansion device 14, the second heat exchanger 11*b*, and the four-way valve 15 in this order.

Although the four-way valve 15 is described as an example of "a refrigerant circuit switching device" in Embodiments 1 and 2, a component capable of selecting one of refrigerant circuits, such as that combines two two-way valves, may be used as "a refrigerant circuit switching device".

(A Moisture Adsorbing Unit 16)

The dehumidifying apparatus 100 includes the moisture adsorbing unit 16. Here, the moisture adsorbing unit 16 is formed by a polygonal (e.g., rectangular, pentagonal, hexagonal, or octagonal) or circular porous flat plate extending along the cross-section of the air passage so as to take up a large cross-sectional area for ventilation with respect to the air passage cross-sectional area of the airflow passage 10*a* of the dehumidifying apparatus 100. The moisture adsorbing unit 16 is configured to allow air to pass therethrough in the direction of thickness thereof. The moisture adsorbing unit 16 is secured in the airflow passage 10*a* and kept at rest.

The surface of the porous flat plate forming the moisture adsorbing unit 16 is coated, treated, or impregnated with an adsorbing material, such as zeolite, silica gel, or activated carbon, having properties of adsorbing moisture from relatively high-humidity air and desorbing moisture into relatively low-humidity air.

FIG. 2 shows the amount of moisture that can be adsorbed by (or the amount of equilibrium adsorption of) the adsorbing material used in the moisture adsorbing unit 16, with respect to the relative humidity of air. The amount of equilibrium adsorption generally increases as the relative humidity of air increases. The adsorbing material used in the dehumidifying apparatus 100 has a large difference between the amount of equilibrium adsorption at a relative humidity of 80% or more and the amount of equilibrium adsorption at a relative humidity of 40% to 60%. This can improve the adsorbing and desorbing capability of the moisture adsorbing unit 16. The large difference in the amount of an equilibrium adsorption means that there is at least one point where the amount of equilibrium adsorption at a relative humidity of 80% or more is greater than or equal to 1.5 times the amount of equilibrium adsorption at a relative humidity of 40% to 60%.

(A Flow Control Device 17)

The flow control device 17 is capable of controlling the amount of refrigerant flowing into the third heat exchanger 11*c*. For example, the flow control device 17 can be formed by a mechanical opening and closing valve, a three-way valve, or an expansion valve.

When a mechanical opening and closing valve is used, the mechanical opening and closing valve may be mounted near the inlet of each of the bypass flow passage and the third heat exchanger 11*c*, or may be mounted on the inlet flow passage of each of the bypass flow passage and the third heat exchanger 11*c*.

When a three-way valve is used, its inlet may be connected to the discharge pipe of the compressor, one of its outlets may be connected to the inlet of the third heat exchanger 11*c*, and the other outlet may be connected to the inlet of the bypass flow passage so that the three-way valve can be operated to allow the refrigerant to pass through only one of the third heat exchanger 11*c* and the bypass flow passage.

When an expansion valve is used, the expansion valve may be disposed at the inlet of the third heat exchanger 11*c* or in the bypass flow passage.

Figure 13:
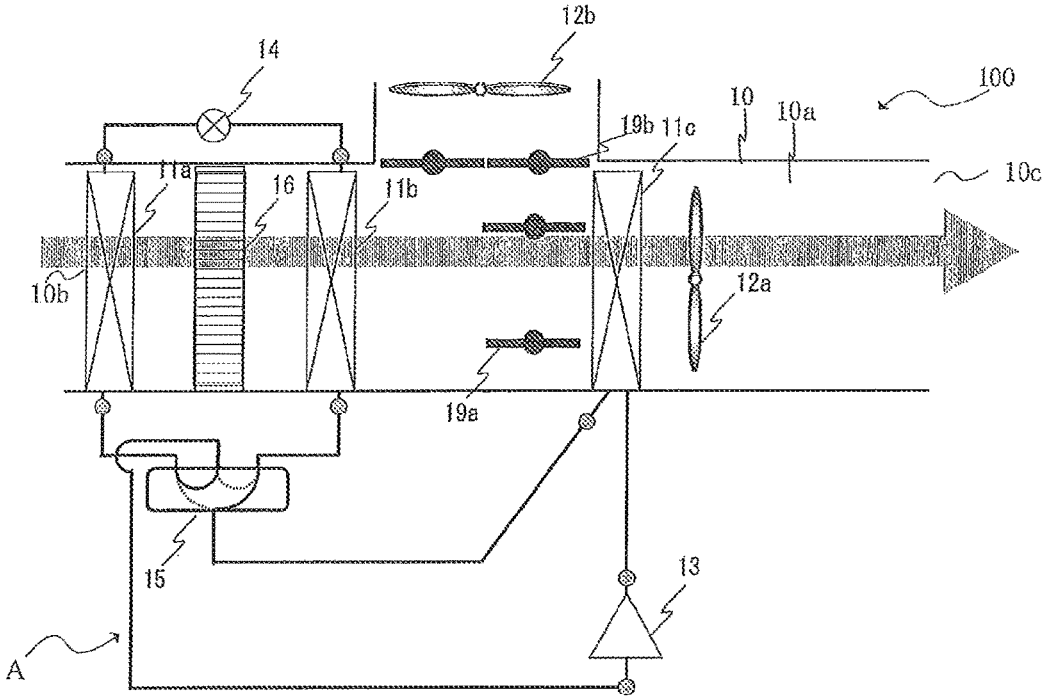
FIG. 13 is a schematic diagram illustrating still another exemplary general configuration of the dehumidifying apparatus according to Embodiment 1 of the present invention.
Figure 13:
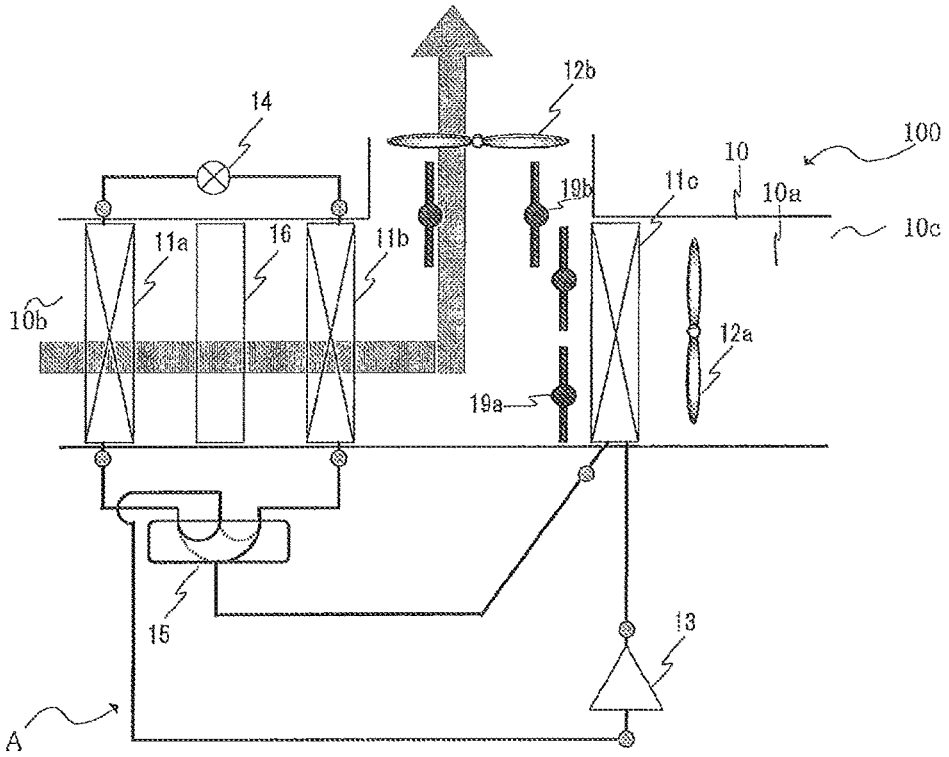

Instead of controlling the flow rate of the refrigerant, the flow control device 17 may control the volume of air. The flow control device 17 may control either the flow rate of the refrigerant or the volume of air passing through the third heat exchanger 11*c* as long as the amount of heating in the third heat exchanger 11*c* can be controlled. A device configuration for controlling the volume of air is illustrated in FIG. 13.

(Refrigerant)

The refrigerant used in the refrigerant circuit A is, for example, an HFC refrigerant such as R410A, R407C, or R404A, an HCFC refrigerant such as R22 or R134a, or a natural refrigerant such as hydrocarbon or helium.

(Sensor Arrangement in Refrigerant Circuit A)

A plurality of sensors are arranged in the refrigerant circuit A of the dehumidifying apparatus 100.

A discharge temperature sensor 1*a* is disposed on the discharge side of the compressor 13, and configured to detect the temperature of the refrigerant discharged from the compressor 13.

A suction temperature sensor 1*b* is disposed on the suction side of the compressor 13, and configured to detect the temperature of the refrigerant suctioned into the compressor 13.

A temperature sensor 1*c* is disposed on the inlet side of the third heat exchanger 11*c*, and configured to detect the temperature of the refrigerant flowing into the third heat exchanger 11*c*.

A temperature sensor 1*d* is disposed on the outlet side of the third heat exchanger 11*c*, and configured to detect the temperature of the refrigerant flowing out of the third heat exchanger 11*c*.

Temperature sensors 1*e* and 1*f* are disposed on the inlet and outlet sides of the second heat exchanger 11*b*, and each configured to detect the temperature of the refrigerant flowing into or out of the second heat exchanger 11*b*.

Temperature sensors 1*g* and 1*h* are disposed on the inlet and outlet sides of the first heat exchanger 11*a*, and each configured to detect the temperature of the refrigerant flowing into or out of the first heat exchanger 11*a*.

The dehumidifying apparatus 100 includes a counter (counter 4 illustrated in FIG. 14) configured to detect the dehumidifying operation time. The dehumidifying apparatus 100 further includes a control circuit (control circuit 5 illustrated in FIG. 14) to which measurement information from the discharge temperature sensor 1*a*, the suction temperature sensor 1*b*, the temperature sensors 1*c* to 1*h*, the temperature and humidity sensors 2*a* to 2*e*, the air speed sensor 3, and the counter 4 is input. On the basis of information from various sensors, the control circuit 5 controls various actuators to execute each operation mode described below.

<First Operation Mode: Refrigerant Flow Passage (First Refrigerant Flow Passage) 101>

Figure 3:
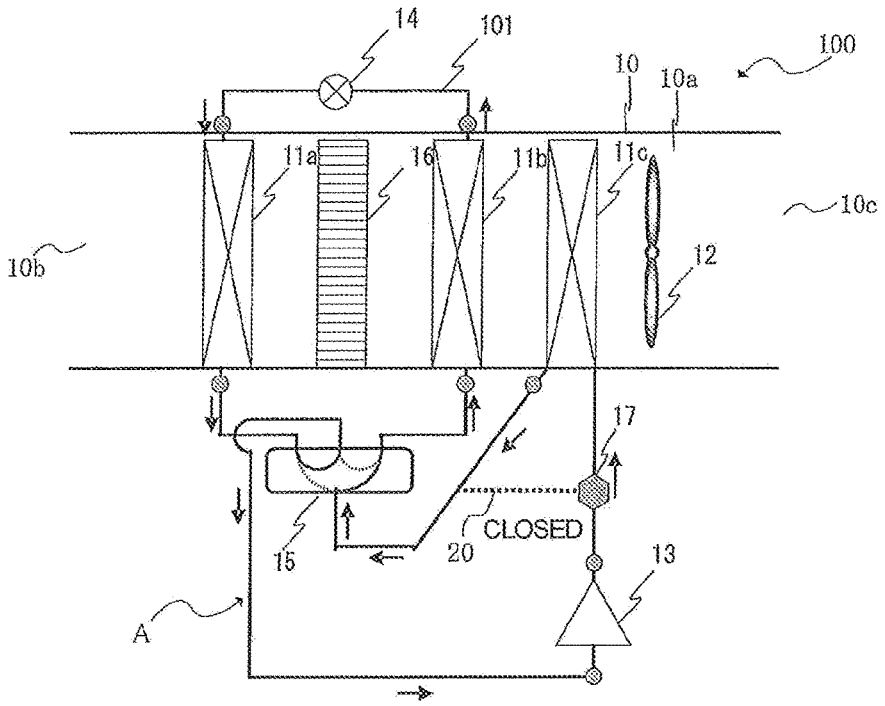
FIG. 3 is a schematic circuit diagram illustrating a refrigerant circulation path in a first operation mode of the dehumidifying apparatus according to Embodiment 1 of the present invention.

FIG. 3 is a schematic circuit diagram illustrating a refrigerant circulation path in the first operation mode of the dehumidifying apparatus 100. On the basis of FIG. 3, a refrigerant operation in the refrigerant flow passage 101 in the first operation mode in the refrigerant circuit A of the dehumidifying apparatus 100 will be described.

In the first operation mode, the third heat exchanger 11*c* serves as a condenser, the second heat exchanger 11*b* serves as a condenser, and the first heat exchanger 11*a* serves as an evaporator.

The refrigerant compressed and discharged from the compressor 13 passes through the flow control device 17 and flows into the third heat exchanger 11*c*. The refrigerant that has flowed into the third heat exchanger 11*c* serving as a condenser is partially converted to condensate while exchanging heat with air. After passing through the third heat exchanger 11*c*, the refrigerant passes through the four-way valve 15 and flows into the second heat exchanger 11*b*. The refrigerant that has flowed into the second heat exchanger 11*b* serving as a condenser is converted to condensate while exchanging heat with air, and flows into the expansion device 14. After the pressure of the refrigerant is reduced by the expansion device 14, the refrigerant flows into the first heat exchanger 11*a*. The refrigerant that has flowed into the first heat exchanger 11*a* serving as an evaporator exchanges heat with air and evaporates, passes through the four-way valve 15, and is suctioned into the compressor 13 again.

<Second Operation Mode: Refrigerant Flow Passage 102*a*>

Figure 4:
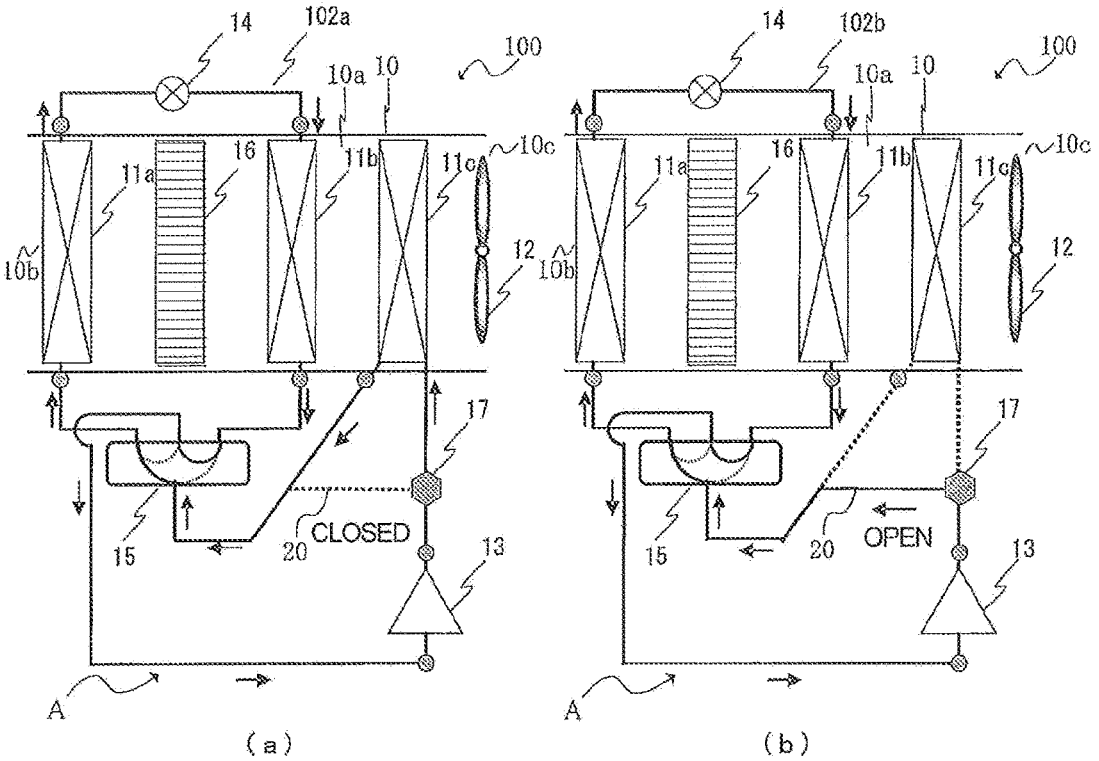
FIG. 4 is a schematic circuit diagram illustrating a refrigerant circulation path in a second operation mode of the dehumidifying apparatus according to Embodiment 1 of the present invention.

FIG. 4 is a schematic circuit diagram illustrating a refrigerant circulation path in the second operation mode of the dehumidifying apparatus 100. FIG. 4(*a*) illustrates the refrigerant flow passage 102*a*, and FIG. 4(*b*) illustrates the refrigerant flow passage 102*b*. First, on the basis of FIG. 4(*a*), a refrigerant operation in the refrigerant flow passage 102*a* in the second operation mode in the refrigerant circuit A of the dehumidifying apparatus 100 will be described.

In the second operation mode, the third heat exchanger 11*c* serves as a condenser, the second heat exchanger 11*b* serves as an evaporator, and the first heat exchanger 11*a* serves as a condenser.

The refrigerant compressed and discharged from the compressor 13 passes through the flow control device 17 and flows into the third heat exchanger 11*c*. The refrigerant that has flowed into the third heat exchanger 11*c* serving as a condenser is partially converted to condensate while exchanging heat with air. After passing through the third heat exchanger 11*c*, the refrigerant passes through the four-way valve 15 and flows into the first heat exchanger 11*a*. The refrigerant that has flowed into the first heat exchanger 11*a* serving as a condenser is converted to condensate while exchanging heat with air, and flows into the expansion device 14. After the pressure of the refrigerant is reduced by the expansion device 14, the refrigerant flows into the second heat exchanger 11*b*. The refrigerant that has flowed into the second heat exchanger 11*b* serving as an evaporator exchanges heat with air and evaporates, passes through the four-way valve 15, and is suctioned into the compressor 13 again.

<Second Operation Mode: Refrigerant Flow Passage 102*b*>

Next, on the basis of FIG. 4(*b*), a refrigerant operation in the refrigerant flow passage 102*b* in the second operation mode in the refrigerant circuit A of the dehumidifying apparatus 100 will be described.

The refrigerant compressed and discharged from the compressor 13 passes through the flow control device 17, bypasses the third heat exchanger 11*c*, passes through the four-way valve 15, and flows into the first heat exchanger 11*a*. The refrigerant that has flowed into the first heat exchanger 11*a* serving as a condenser is converted to condensate while exchanging heat with air, and flows into the expansion device 14. After the pressure of the refrigerant is reduced by the expansion device 14, the refrigerant flows into the second heat exchanger 11*b*. The refrigerant that has flowed into the second heat exchanger 11*b* serving as an evaporator exchanges heat with air and evaporates, passes through the four-way valve 15, and is suctioned into the compressor 13 again.

<Third Operation Mode: Refrigerant Flow Passage 103>

Figure 5:
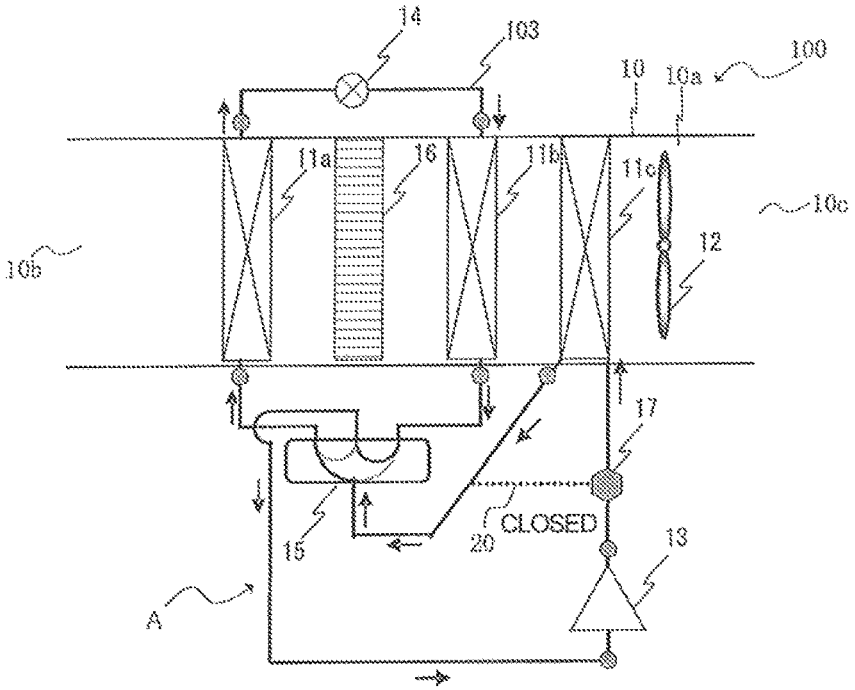
FIG. 5 is a schematic circuit diagram illustrating a refrigerant circulation path in a third operation mode of the dehumidifying apparatus according to Embodiment 1 of the present invention.

FIG. 5 is a schematic circuit diagram illustrating a refrigerant circulation path in the third operation mode of the dehumidifying apparatus 100. On the basis of FIG. 5, a refrigerant operation in the refrigerant flow passage 103 in the third operation mode in the refrigerant circuit A of the dehumidifying apparatus 100 will be described.

In the third operation mode, the third heat exchanger 11*c* serves as a condenser, the second heat exchanger 11*b* serves as an evaporator, and the first heat exchanger 11*a* serves as a condenser.

The refrigerant compressed and discharged from the compressor 13 passes through the flow control device 17 and flows into the third heat exchanger 11*c*. The refrigerant that has flowed into the third heat exchanger 11*c* serving as a condenser is partially converted to condensate while exchanging heat with air.

After passing through the third heat exchanger 11*c*, the refrigerant passes through the four-way valve 15 and flows into the first heat exchanger 11*a*. The refrigerant that has flowed into the first heat exchanger 11*a* serving as a condenser is converted to condensate while exchanging heat with air, and flows into the expansion device 14. After the pressure of the refrigerant is reduced by the expansion device 14, the refrigerant flows into the second heat exchanger 11*b*. The refrigerant that has flowed into the second heat exchanger 11*b* serving as an evaporator exchanges heat with air and evaporates, passes through the four-way valve 15, and is suctioned into the compressor 13 again.

<Fourth Operation Mode: Refrigerant Flow Passage 104*a*>

Figure 6:
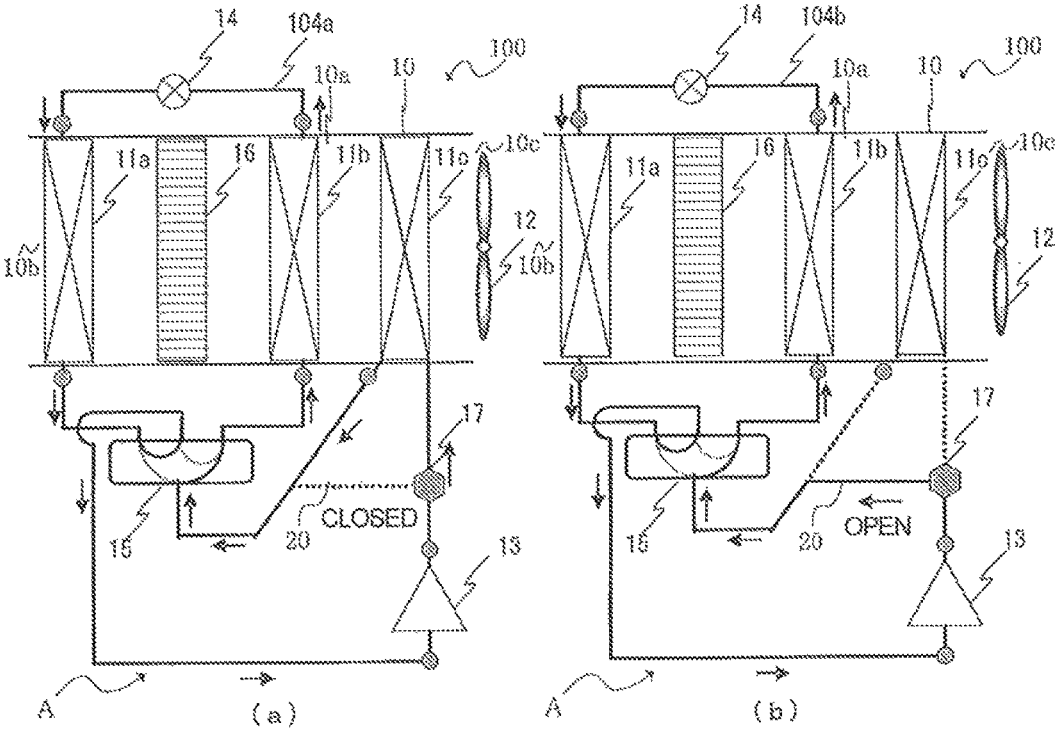
FIG. 6 is a schematic circuit diagram illustrating a refrigerant circulation path in a fourth operation mode of the dehumidifying apparatus according to Embodiment 1 of the present invention.

FIG. 6 is a schematic circuit diagram illustrating a refrigerant circulation path in the fourth operation mode of the dehumidifying apparatus 100. FIG. 6(*a*) illustrates the refrigerant flow passage 104*a*, and FIG. 6(*b*) illustrates the refrigerant flow passage 104*b*. First, on the basis of FIG. 6(*a*), a refrigerant operation in the refrigerant flow passage 104*a* in the fourth operation mode in the refrigerant circuit A of the dehumidifying apparatus 100 will be described.

In the fourth operation mode, the third heat exchanger 11*c* serves as a condenser, the second heat exchanger 11*b* serves as a condenser, and the first heat exchanger 11*a* serves as an evaporator.

The refrigerant compressed and discharged from the compressor 13 passes through the flow control device 17 and flows into the third heat exchanger 11*c*. The refrigerant that has flowed into the third heat exchanger 11*c* serving as a condenser is partially converted to condensate while exchanging heat with air. After passing through the third heat exchanger 11*c*, the refrigerant passes through the four-way valve 15 and flows into the second heat exchanger 11*b*. The refrigerant that has flowed into the second heat exchanger 11*b* serving as a condenser is converted to condensate while exchanging heat with air, and flows into the expansion device 14. After the pressure of the refrigerant is reduced by the expansion device 14, the refrigerant flows into the first heat exchanger 11*a*. The refrigerant that has flowed into the first heat exchanger 11*a* serving as an evaporator exchanges heat with air and evaporates, passes through the four-way valve 15, and is suctioned into the compressor 13 again.

<Fourth Operation Mode: Refrigerant Flow Passage 104*b*>

Next, on the basis of FIG. 6(*b*), a refrigerant operation in the refrigerant flow passage 104*b* in the fourth operation mode in the refrigerant circuit A of the dehumidifying apparatus 100 will be described.

The refrigerant compressed and discharged from the compressor 13 passes through the flow control device 17, bypasses the third heat exchanger 11*c*, passes through the four-way valve 15, and flows into the second heat exchanger 11*b*. The refrigerant that has flowed into the second heat exchanger 11*b* serving as a condenser is converted to condensate while exchanging heat with air, and flows into the expansion device 14. After the pressure of the refrigerant is reduced by the expansion device 14, the refrigerant flows into the first heat exchanger 11*a*. The refrigerant that has flowed into the first heat exchanger 11*a* serving as an evaporator exchanges heat with air and evaporates, passes through the four-way valve 15, and is suctioned into the compressor 13 again.

<Dehumidifying Operation of Dehumidifying Apparatus 100>

An air operation in each operation mode of the dehumidifying apparatus 100 will be described using FIGS. 7 to 10.

Figure 7:
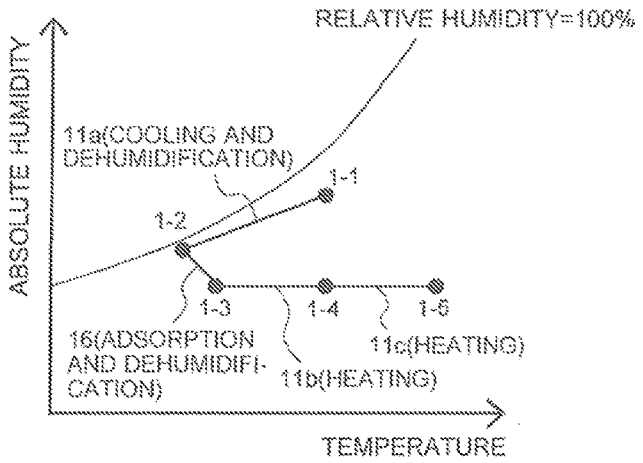
FIG. 7 is a moist air diagram showing the temperature and humidity in the first operation mode of the dehumidifying apparatus according to Embodiment 1 of the present invention.
Figure 8:
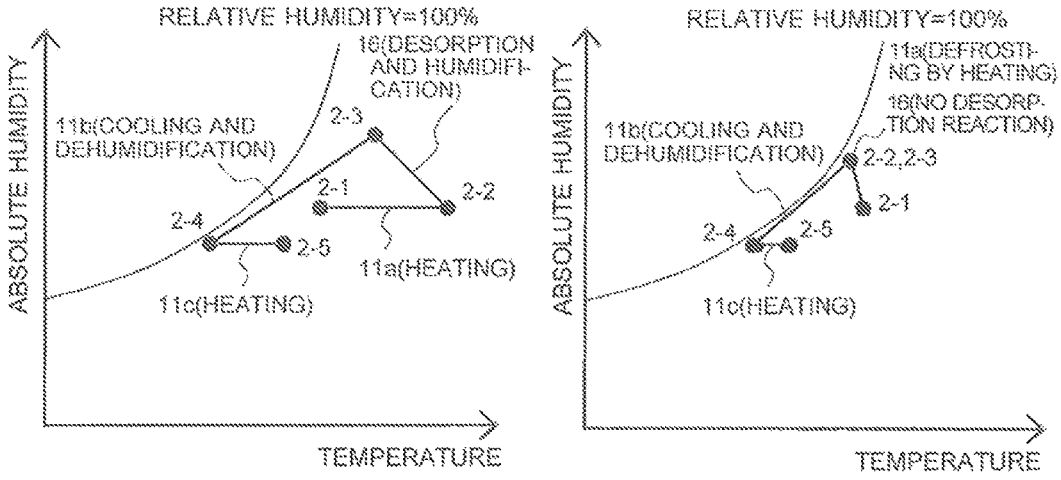
FIG. 8 provides moist air diagrams showing the temperature and humidity in the second operation mode of the dehumidifying apparatus according to Embodiment 1 of the present invention.
Figure 9:
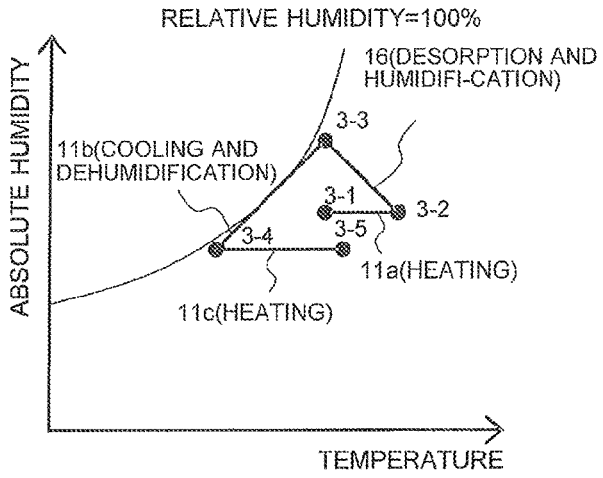
FIG. 9 is a moist air diagram showing the temperature and humidity in the third operation mode of the dehumidifying apparatus according to Embodiment 1 of the present invention.
Figure 10:
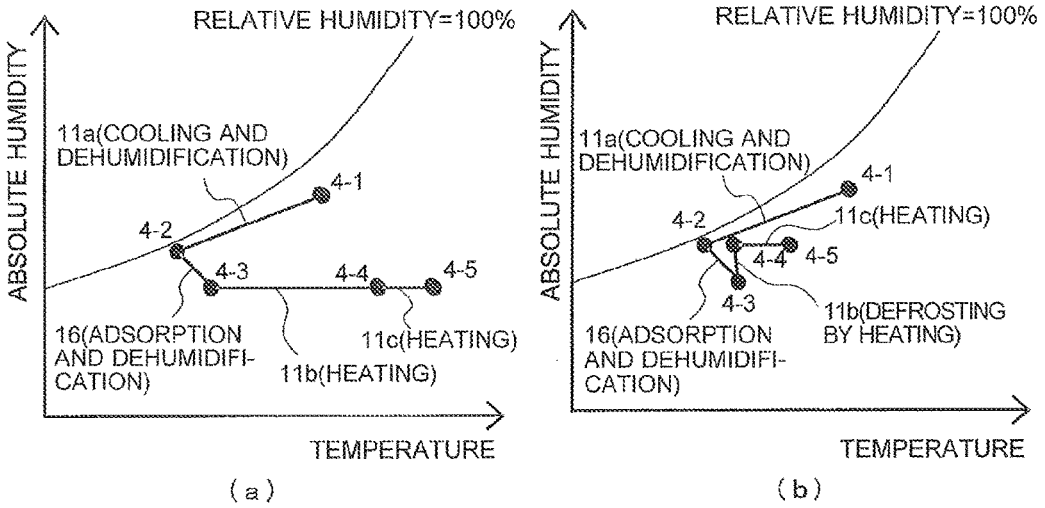
FIG. 10 provides moist air diagrams showing the temperature and humidity in the fourth operation mode of the dehumidifying apparatus according to Embodiment 1 of the present invention.

FIG. 7 is a moist air diagram showing the temperature and humidity in the first operation mode of the dehumidifying apparatus 100. FIG. 8 provides moist air diagrams showing the temperature and humidity in the second operation mode of the dehumidifying apparatus 100. FIG. 9 is a moist air diagram showing the temperature and humidity in the third operation mode of the dehumidifying apparatus 100. FIG. 10 provides moist air diagrams showing the temperature and humidity in the fourth operation mode of the dehumidifying apparatus 100.

The moisture adsorbing unit 16 retains a small amount of moisture in the first and fourth operation modes, and gives an adsorption reaction to high-humidity air (e.g., air with a relative humidity of 70% or more). The moisture adsorbing unit 16 retains a large amount of moisture in the second and third operation modes, and gives a desorption reaction to low-humidity air (e.g., air with a relative humidity of 60% or less). In the second and fourth operation modes, the operation varies depending on whether frost forms on the first heat exchanger 11*a* and the second heat exchanger 11*b*. Therefore, FIGS. 8(*a*) and 10(*a*) each show a case without frost formation, and FIGS. 8(*b*) and 10(*b*) each show a case with frost formation.

(Dehumidifying Operation in First Operation Mode)

A dehumidifying operation in the first operation mode will be described with reference to FIG. 7. Reference numerals 1-1 to 1-5 in FIG. 7 each indicate a state of air in the first operation mode. Specifically, (1-1) indicates the state of inlet air, (1-2) indicates the state of air after its passage through the first heat exchanger 11*a*, (1-3) indicates the state of air after its passage through the moisture adsorbing unit 16, (1-4) indicates the state of air after its passage through the second heat exchanger 11*b*, and (1-5) indicates the state of air after its passage through the third heat exchanger 11*c*.

As described above, in the first operation mode, the third heat exchanger 11*c* serves as a condenser, the second heat exchanger 11*b* serves as a condenser, and the first heat exchanger 11*a* serves as an evaporator.

In the first operation mode of the dehumidifying apparatus 100, air introduced through the air inlet 10*b* of the air passage housing 10 (1-1) is fed to the first heat exchanger 11*a*. The introduced air is cooled by the first heat exchanger 11*a* serving as an evaporator. When the introduced air is cooled to a dew-point temperature or lower, dehumidified air from which moisture has been removed is obtained (1-2) and fed to the moisture adsorbing unit 16. Since the relative humidity of the cooled and dehumidified air is as high as about 70% to 90% RH, the adsorbing material of the moisture adsorbing unit 16 easily adsorbs moisture.

By adsorption of moisture into the adsorbing material of the moisture adsorbing unit 16, the cooled introduced air is dehumidified, and the resulting high-temperature low-humidity air flows into the second heat exchanger 11*b* (1-3). The second heat exchanger 11*b*, which serves as a condenser, heats the introduced air that has flowed into the second heat exchanger 11*b* and raises the passing air temperature (1-4). After passing through the second heat exchanger 11*b*, the air flows into the third heat exchanger 11*c*. The third heat exchanger 11*c*, which serves as a condenser, raises the temperature of the passing air that has flowed into the third heat exchanger 11*c* (1-5), and the resulting air is discharged from the air outlet 10*c*.

(Dehumidifying Operation in Second Operation Mode)

A dehumidifying operation in the second operation mode will be described with reference to FIG. 8. Reference numerals 2-1 to 2-5 in FIG. 8 each indicate a state of air in the second operation mode. Specifically, (2-1) indicates the state of inlet air, (2-2) indicates the state of air after its passage through the first heat exchanger 11*a*, (2-3) indicates the state of air after its passage through the moisture adsorbing unit 16, (2-4) indicates the state of air after its passage through the second heat exchanger 11*b*, and (2-5) indicates the state of air after its passage through the third heat exchanger 11*c*.

As described above, in the second operation mode, the third heat exchanger 11*c* serves as a condenser, the second heat exchanger 11*b* serves as an evaporator, and the first heat exchanger 11*a* serves as a condenser.

First, a case without frost formation will be described with reference to FIG. 8(*a*).

In the second mode of the dehumidifying apparatus 100, air introduced through the air inlet 10*b* of the air passage housing 10 (2-1) is fed to the first heat exchanger 11*a*. The introduced air is heated by the first heat exchanger 11*a* serving as a condenser. The first heat exchanger 11*a* raises the passing air temperature of the introduced air (2-2), which is fed to the moisture adsorbing unit 16. Since the relative humidity of the heated air is lower than that of the inlet air, the adsorbing material of the moisture adsorbing unit 16 easily desorbs moisture.

Additionally, since the amount of refrigerant flowing into the first heat exchanger 11*a* is greater than that in the third operation mode (described below), the amount of heating in the first heat exchanger 11*a* is greater than that in the third operation mode. Therefore, if the temperature, humidity, and volume of air flowing into the first heat exchanger 11*a* in the second operation mode are the same as those in the third operation mode, the relative humidity of air after its passage through the first heat exchanger 11*a* in the second operation mode is lower than that in the third operation mode.

By desorption of moisture from the adsorbing material of the moisture adsorbing unit 16, the heated air is humidified, and the resulting low-temperature high-humidity air flows into the second heat exchanger 11*b* (2-3). The second heat exchanger 11*b*, which serves as an evaporator, cools the passing air that has flowed into the second heat exchanger 11*b*. When the passing air is cooled to a dew-point temperature or lower by the second heat exchanger 11*b*, dehumidified air from which moisture has been removed is obtained (2-4). After passing through the second heat exchanger 11*b*, the air flows into the third heat exchanger 11*c*. The third heat exchanger 11*c*, which serves as a condenser, raises the temperature of the passing air that has flowed into the third heat exchanger 11*c* (2-5), and the resulting air is discharged from the air outlet 10*c*.

Next, a case with frost formation will be described with reference to FIG. 8(*b*). Here, the term frost formation means that frost forms on the first heat exchanger 11*a*.

In the second mode of the dehumidifying apparatus 100, air introduced through the air inlet 10*b* of the air passage housing 10 (2-1) is fed to the first heat exchanger 11*a*. Since frost forms on the first heat exchanger 11*a*, the first heat exchanger 11*a* serving as a condenser performs defrosting. The relative humidity at the temperature of the air that has passed through the first heat exchanger 11*a* is increased by the deforesting (2-2), and the resulting air is fed to the moisture adsorbing unit 16. Here, the air temperature varies depending on the temperature and humidity of the inlet air and the state of defrosting.

The air flows into the moisture adsorbing unit 16 but due to its high relative humidity, the moisture is not easily desorbed from the adsorbing material of the moisture adsorbing unit 16 as compared to the case without frost formation (adsorption and desorption reactions change with time). After passing through the moisture adsorbing unit 16, the air flows into the second heat exchanger 11*b* (2-3). The second heat exchanger 11*b*, which serves as an evaporator, cools the passing air. When the passing air is cooled to a dew-point temperature or lower by the second heat exchanger 11*b*, dehumidified air from which moisture has been removed is obtained (2-4). After passing through the second heat exchanger 11*b*, the air flows into the third heat exchanger 11*c*. The third heat exchanger 11*c*, which serves as a condenser, raises the passing air temperature (2-5), and the resulting air is discharged from the air outlet 10*c*.

(Dehumidifying Operation in Third Operation Mode)

A dehumidifying operation in the third operation mode will be described with reference to FIG. 9. Reference numerals 3-1 to 3-5 in FIG. 9 each indicate a state of air in the third operation mode. Specifically, (3-1) indicates the state of inlet air, (3-2) indicates the state of air after its passage through the first heat exchanger 11*a*, (3-3) indicates the state of air after its passage through the moisture adsorbing unit 16, (3-4) indicates the state of air after its passage through the second heat exchanger 11*b*, and (3-5) indicates the state of air after its passage through the third heat exchanger 11*c*.

As described above, in the third operation mode, the third heat exchanger 11*c* serves as a condenser, the second heat exchanger 11*b* serves as an evaporator, and the first heat exchanger 11*a* serves as a condenser.

In the third operation mode of the dehumidifying apparatus 100, air introduced through the air inlet 10*b* of the air passage housing 10 (3-1) is fed to the first heat exchanger 11*a*. The introduced air is heated by the first heat exchanger 11*a* serving as a condenser. The first heat exchanger 11*a* raises the passing air temperature of the introduced air (3-2), and the resulting air is fed to the moisture adsorbing unit 16. By desorption of moisture from the adsorbing material of the moisture adsorbing unit 16, the heated air is humidified, and the resulting low-temperature high-humidity air flows into the second heat exchanger 11*b* (3-3).

The second heat exchanger 11*b*, which serves as an evaporator, cools the passing air that has flowed into the second heat exchanger 11*b*. When the passing air is cooled to a dew-point temperature or lower by the second heat exchanger 11*b*, dehumidified air from which moisture has been removed is obtained (3-4). After passing through the second heat exchanger 11*b*, the air flows into the third heat exchanger 11*c*. The third heat exchanger 11*c*, which serves as a condenser, raises the temperature of the passing air that has flowed into the third heat exchanger 11*c* (3-5), and the resulting air is discharged from the air outlet 10*c*.

(Dehumidifying Operation in Fourth Operation Mode)

A dehumidifying operation in the fourth operation mode will be described with reference to FIG. 10. Reference numerals 4-1 to 4-5 in FIG. 10 each indicate a state of air in the fourth operation mode. Specifically, (4-1) indicates the state of inlet air, (4-2) indicates the state of air after its passage through the first heat exchanger 11*a*, (4-3) indicates the state of air after its passage through the moisture adsorbing unit 16, (4-4) indicates the state of air after its passage through the second heat exchanger 11*b*, and (4-5) indicates the state of air after its passage through the third heat exchanger 11*c*.

As described above, in the fourth operation mode, the third heat exchanger 11*c* serves as a condenser, the second heat exchanger 11*b* serves as a condenser, and the first heat exchanger 11*a* serves as an evaporator.

First, a case without frost formation will be described with reference to FIG. 10(*a*).

In the fourth mode of the dehumidifying apparatus 100, air introduced through the air inlet 10*b* of the air passage housing 10 (4-1) is fed to the first heat exchanger 11*a*. The introduced air is cooled by the first heat exchanger 11*a* serving as an evaporator. When the passing air is cooled to a dew-point temperature or lower by the first heat exchanger 11*a*, dehumidified air from which moisture has been removed is obtained (4-2) and fed to the moisture adsorbing unit 16. Since the relative humidity of the cooled and dehumidified air is as high as about 70% to 90% RH, the adsorbing material of the moisture adsorbing unit 16 easily adsorbs moisture.

By adsorption of moisture into the adsorbing material of the moisture adsorbing unit 16, the introduced air cooled by the first heat exchanger 11*a* is dehumidified, and the resulting high-temperature low-humidity air flows into the second heat exchanger 11*b* (4-3). The second heat exchanger 11*b*, which serves as a condenser, heats the introduced air that has flowed into the second heat exchanger 11*b* and raises the passing air temperature (4-4). After passing through the second heat exchanger 11*b*, the air flows into the third heat exchanger 11*c*. The third heat exchanger 11*c*, which serves as a condenser, raises the passing air temperature (4-5), and the resulting air is discharged from the air outlet 10*c*.

(Fourth Operation Mode: With Frost Formation)

Next, a case with frost formation will be described with reference to FIG. 10(*b*). Here, the term frost formation means that frost forms on the second heat exchanger 11*b*.

In the fourth mode of the dehumidifying apparatus 100, air introduced through the air inlet 10*b* of the air passage housing 10 (4-1) is fed to the first heat exchanger 11*a*. The introduced air is cooled by the first heat exchanger 11*a* serving as an evaporator. When the passing air is cooled to a dew-point temperature or lower by the first heat exchanger 11*a*, dehumidified air from which moisture has been removed is obtained (4-2) and fed to the moisture adsorbing unit 16. Since the relative humidity of the cooled and dehumidified air is as high as about 70% to 90% RH, the adsorbing material of the moisture adsorbing unit 16 easily adsorbs moisture.

By adsorption of moisture into the adsorbing material of the moisture adsorbing unit 16, the introduced air cooled by the first heat exchanger 11*a* is dehumidified, and the resulting high-temperature low-humidity air flows into the second heat exchanger 11*b* (4-3). Since frost forms on the second heat exchanger 11*b*, the second heat exchanger 11*b* serving as a condenser performs defrosting. The relative humidity at the temperature of the air that has passed through the second heat exchanger 11*b* is increased by the deforesting (4-4). After passing through the second heat exchanger 11*b*, the air flows into the third heat exchanger 11*c*. The third heat exchanger 11*c*, which serves as a condenser, raises the passing air temperature (4-5), and the resulting air is discharged from the air outlet 10*c*.

<Operation-Mode Changing Control>

Figure 11:
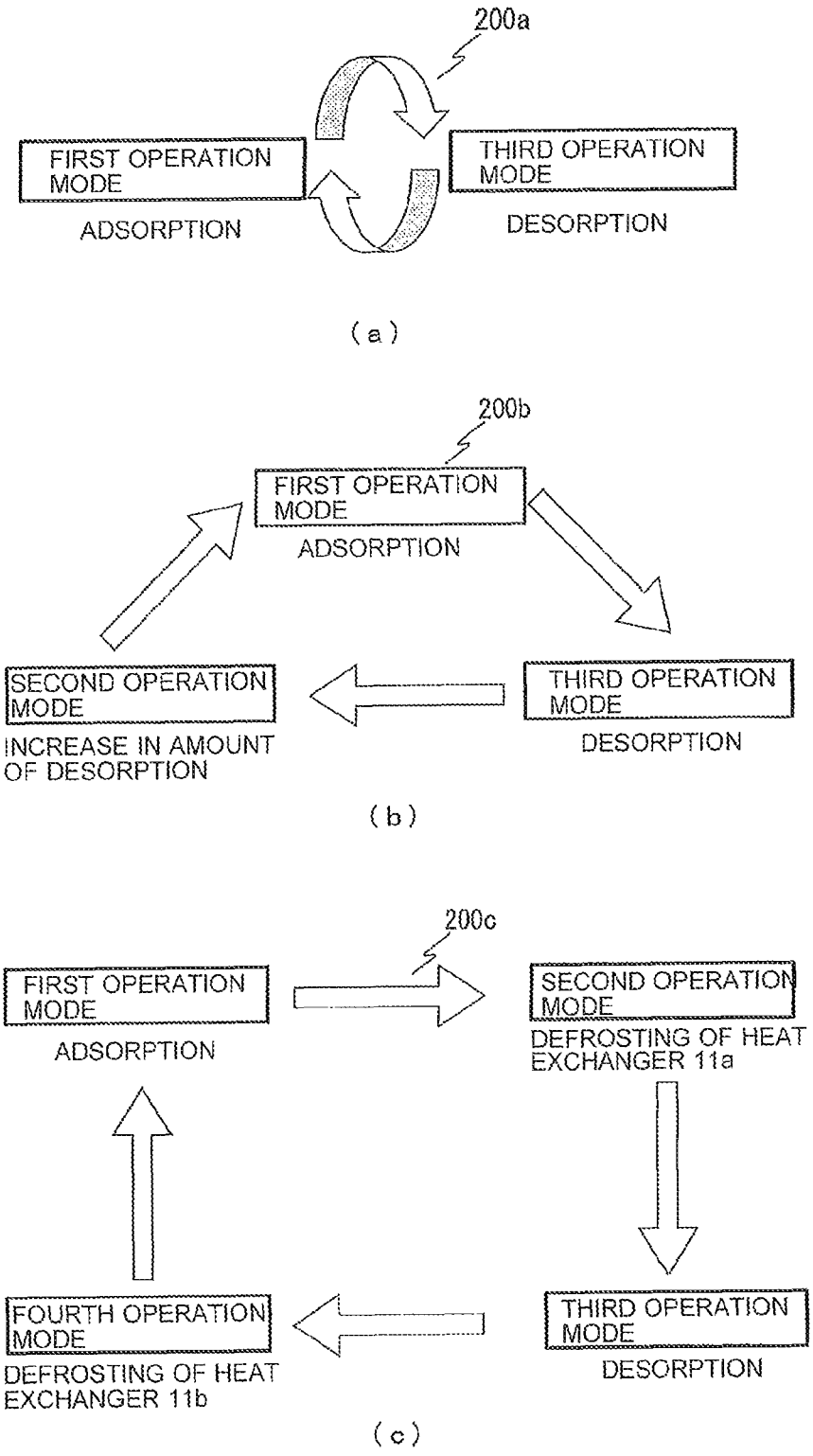
FIG. 11 schematically illustrates an example of operation-mode changing control in the dehumidifying apparatus according to Embodiment 1 of the present invention.

Operation-mode changing control in the dehumidifying apparatus 100 will be described with reference to FIG. 11. FIG. 11 schematically illustrates an example of operation-mode changing control in the dehumidifying apparatus 100. FIG. 11(*a*) illustrates a change in operation mode between the first operation mode and the third operation mode. FIG. 11(*b*) illustrates a change in operation mode from the first operation mode to the third operation mode, and then to the second operation mode. FIG. 11(*c*) illustrates a change in operation mode from the first operation mode to the second operation mode, then to the third operation mode, and to the fourth operation mode.

(Operation-Mode Changing Control 200*a*)

Referring to FIG. 11(*a*), the adsorption reaction and the desorption reaction of the adsorbing material of the moisture adsorbing unit 16 are repeated by switching between the first operation mode and the third operation mode. Operation-mode changing control 200*a* is used in a normal operation, such as an operation under high humidity conditions (e.g., 25 degrees C., 70%) where there is no frost formation and a heat source required for desorption can be provided without operating the flow control device 17.

(Operation-Mode Changing Control 200*b*)

Referring to FIG. 11(*b*), the adsorption reaction and the desorption reaction of the adsorbing material of the moisture adsorbing unit 16 are repeated by switching the operation mode from the first operation mode to the third operation mode, and then to the second operation mode. The switching from the third operation mode to the second operation mode is to increase the amount of condensation heat in the first heat exchanger 11*a* to allow air with a lower humidity than that in the third operation mode to flow into the moisture adsorbing unit 16, so as to increase the amount of moisture to be desorbed and the amount of moisture that can be adsorbed. Therefore, operation-mode changing control 200*b* is applied, for example, to low humidity conditions (e.g., 25 degrees C., 30%) where there is no frost formation and a heat source required for desorption needs to be provided by operating the flow control device 17.

In the operation-mode changing control 200*a* and 200*b*, the determination of whether to change to each operation mode is made, for example, in accordance with time or with difference in temperature, difference in absolute humidity, variation in relative humidity, or variation in pressure loss in the air passage (when, due to swelling by adsorption, there is an increase in the pressure loss of air passing through the moisture adsorbing unit 16) between before and after the moisture adsorbing unit 16. However, criteria that can be used are not limited to them. Any criteria can be used as long as it is possible to determine whether adsorption and desorption reactions of the moisture adsorbing unit 16 fully take place, and the form of detecting means is not particularly limited.

(Operation-Mode Changing Control 200*c*)

Referring to FIG. 11(*c*), the adsorption reaction and the desorption reaction of the adsorbing material of the moisture adsorbing unit 16 are repeated and a defrosting operation is performed by switching the operation mode from the first operation mode to the second operation mode, then to the third operation mode, and to the fourth operation mode. In the first operation mode, cooling and dehumidification in the first heat exchanger 11*a* cause frost formation, and the adsorption reaction of the moisture adsorbing unit 16 occurs. In the second operation mode, the first heat exchanger 11*a* is defrosted. In the third operation mode, cooling and dehumidification in the second heat exchanger 11*b* cause frost formation, and the desorption reaction of the moisture adsorbing unit 16 occurs. In the fourth operation mode, the second heat exchanger 11*b* is defrosted. Therefore, operation-mode changing control 200*c* is applied, for example, to low temperature conditions (e.g., 5 degrees C., 80%) where defrosting needs to be done by operating the flow control device 17.

The temperature and humidity of inflow air in the first operation mode may differ from those of inflow air in the third operation mode. This means that frost formation may occur in the first operation mode, but may not occur in the third operation mode. In this case, the operation mode may be changed, with the time for the fourth operation mode set to zero.

In the operation-mode changing control 200*c*, the determination of whether to change from the first operation mode to the second operation mode, and the determination of whether to change from the third operation mode to the fourth operation mode, are made, for example, in accordance with time or with difference in temperature, difference in absolute humidity, variation in relative humidity, or variation in pressure loss in the air passage (when, due to swelling by adsorption, there is an increase in the pressure loss of air passing through the moisture adsorbing unit 16) between before and after the moisture adsorbing unit 16. However, criteria that can be used are not limited to them. Any criteria can be used as long as it is possible to determine whether adsorption and desorption reactions of the moisture adsorbing unit 16 fully take place, and the form of detecting means is not limited.

In the operation-mode changing control 200*c*, the determination of whether to change from the second operation mode to the third operation mode, and the determination of whether to change from the fourth operation mode to the first operation mode, are made, for example, in accordance with time or with difference in temperature, difference in absolute humidity, variation in relative humidity, or variation in pressure loss in the air passage (i.e., a decrease in pressure loss caused by defrosting and detected by the air speed sensor 3) between before and after the frosted heat exchanger. However, criteria that can be used are not limited to them. Any criteria can be used as long as it is possible to determine whether defrosting of the heat exchanger has ended, and the form of detecting means is not limited.

Figure 12:
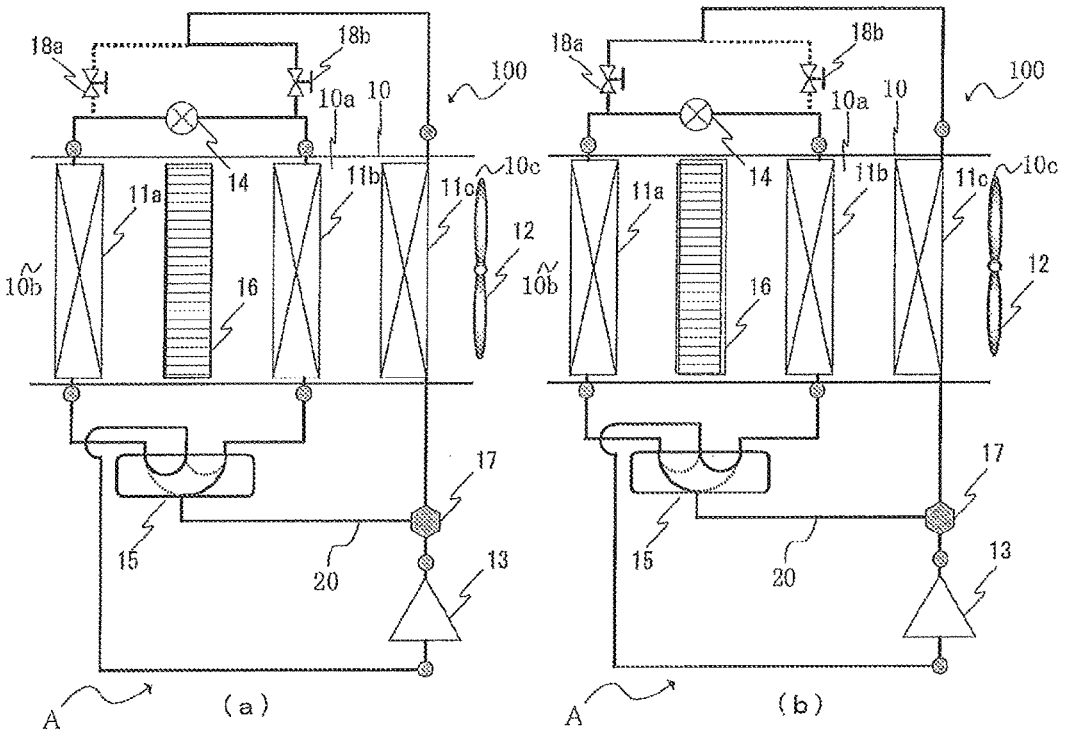
FIG. 12 is a schematic diagram illustrating another exemplary general configuration of the dehumidifying apparatus according to Embodiment 1 of the present invention.

Although a circuit configuration has been described in which condensers are connected in series in the refrigerant circuit A, the condensers may be connected in parallel in the refrigerant circuit A as illustrated in FIG. 12. FIG. 12 is a schematic diagram illustrating another exemplary general configuration of the dehumidifying apparatus 100. FIG. 12(*a*) illustrates a configuration of a circuit (first refrigerant circuit) in which the third heat exchanger 11*c* and the second heat exchanger 11*b* connected in parallel serve as condensers. FIG. 12(*b*) illustrates a configuration of a circuit (second refrigerant circuit) in which the third heat exchanger 11*c* and the first heat exchanger 11*a* connected in parallel serve as condensers.

As illustrated in FIG. 12(*a*), the flow passage on the downstream side of the third heat exchanger 11*c* may be divided into separate passages, which are provided with an opening and closing valve 18*a* and an opening and closing valve 18*b*, and configured to allow the resulting flow to join the refrigerant flowing out of the second heat exchanger 11*b* at an upstream position immediately before the expansion device 14. Alternatively, as illustrated in FIG. 12(*b*), the flow passage on the downstream side of the third heat exchanger 11*c* may be divided into separate passages, which are provided with the opening and closing valve 18*a* and the opening and closing valve 18*b*, and configured to allow the resulting flow to join the refrigerant flowing out of the first heat exchanger 11*a* at an upstream position immediately before the expansion device 14. That is, as long as it is possible to control the heating capability of two condensers, the arrangement of the condensers is not particularly limited. The condensers may be arranged either in series or parallel. The opening and closing valve 18*a* and the opening and closing valve 18*b* are valves each capable of opening the flow passage to allow the flow of refrigerant, and closing the flow passage to block the flow of refrigerant.

The opening and closing valve 18*a* and the opening and closing valve 18*b* correspond to "second a refrigerant circuit switching device" of the present invention.

As illustrated in FIG. 13, an air passage switching device 19*a* and an air passage switching device 19*b* may be disposed between the second heat exchanger 11*b* and the third heat exchanger 11*c*, an air sending device 12*a* may be disposed downstream of the third heat exchanger 11*c*, and an air sending device 12*b* may be disposed between the second heat exchanger 11*b* and the third heat exchanger 11*c*. FIG. 13 is a schematic diagram illustrating still another exemplary general configuration of the dehumidifying apparatus 100. FIG. 13(*a*) illustrates a configuration of an air passage formed by the air sending device 12*a*. FIG. 13(*b*) illustrates a configuration of an air passage formed by the air sending device 12*b*.

As illustrated in FIG. 13(*a*), when the air passage is to be formed by the air sending device 12*a*, the air passage switching device 19*a* and the air passage switching device 19*b* are driven to block air from flowing toward the air sending device 12*b*. As illustrated in FIG. 13(*b*), when the air passage is to be formed by the air sending device 12*b*, the air passage switching device 19*a* and the air passage switching device 19*b* are driven to block air from flowing toward the air sending device 12*a*.

That is, since a similar effect can be achieved by reducing the volume of air flowing into the third heat exchanger 11*c* to reduce the amount of heat rejection, the flow control device 17 may be replaced by the air passage switching device 19*a* and the air passage switching device 19*b* as long as it is possible to control the heating capability of two condensers.

<Control System Configuration>

Figure 14:
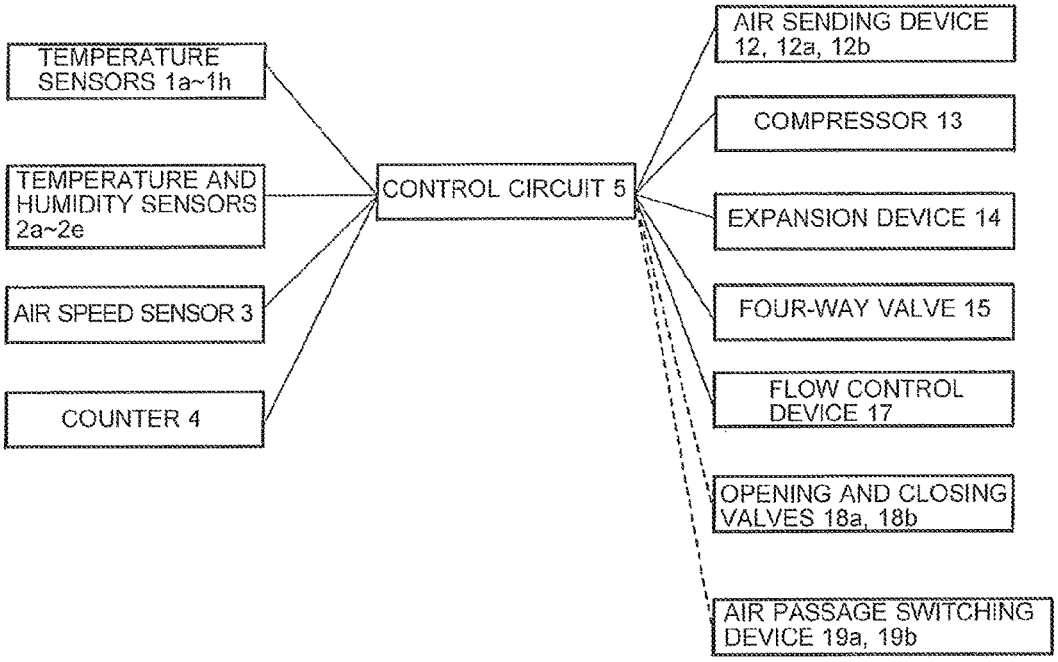
FIG. 14 is a block diagram illustrating a control system configuration of the dehumidifying apparatus according to Embodiment 1 of the present invention.

FIG. 14 is a block diagram illustrating a control system configuration of the dehumidifying apparatus 100.

As described above, the dehumidifying apparatus 100 includes the discharge temperature sensor 1*a*, the suction temperature sensor 1*b*, the temperature sensors 1*c* to 1*h*, the temperature and humidity sensors 2*a* to 2*e*, the air speed sensor 3, the counter 4, the control circuit 5, and various actuators (including the air sending device 12, the air sending device 12*a*, the air sending device 12*b*, the compressor 13, the expansion device 14, the four-way valve 15, the flow control device 17, the opening and closing valve 18*a*, the opening and closing valve 18*b*, the air passage switching device 19*a*, and the air passage switching device 19*b*). As described above, the flow control device 17, the opening and closing valve 18*a*, the opening and closing valve 18*b*, the air passage switching device 19*a*, and the air passage switching device 19*b* may not be included as components.

Information obtained through measurement by the discharge temperature sensor 1*a*, the suction temperature sensor 1*b*, the temperature sensors 1*c* to 1*h*, the temperature and humidity sensors 2*a* to 2*e*, the air speed sensor 3, and the counter 4 is input to the control circuit 5. On the basis of various types of input information, the control circuit 5 controls the drive of various actuators. This allows execution of each operation mode of the dehumidifying apparatus 100. That is, the control circuit 5 is capable of controlling the operation of various actuators on the basis of acquired information, such as temperature and humidity, air speed, and time.

<Effects of Invention>

As described above, the dehumidifying apparatus 100 is capable of changing the temperature and humidity of air flowing into the moisture adsorbing unit 16. By increasing the amount of desorption, the dehumidifying apparatus 100 can increase the amount of adsorption of the moisture adsorbing unit 16 and increase the amount of dehumidification. In the case of frost formation, the dehumidifying apparatus 100 can allow a high-temperature gas discharged from the compressor 13 to flow into a frosted heat exchanger, end the dehumidification in an early stage to increase the amount of time available for dehumidification, and increase the amount of dehumidification per unit time.

Embodiment 2

Figure 15:
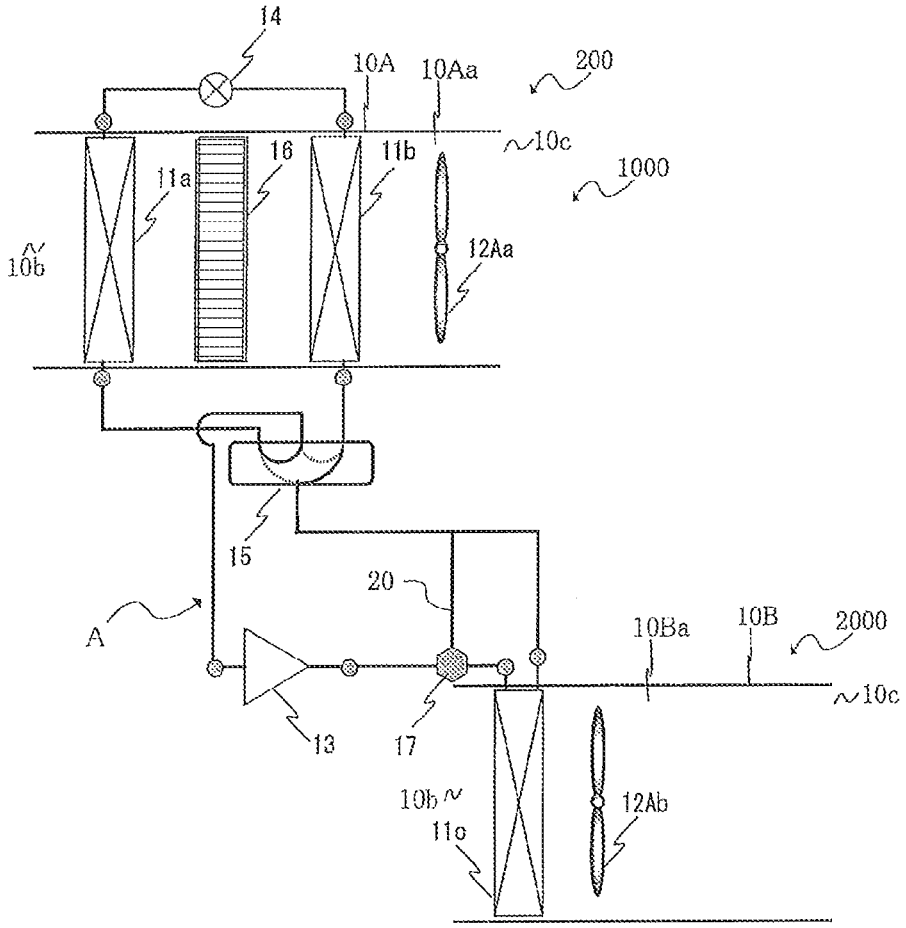
FIG. 15 is a schematic diagram illustrating an exemplary general configuration of a dehumidifying apparatus according to Embodiment 2 of the present invention.

FIG. 15 is a schematic diagram illustrating an exemplary general configuration of a dehumidifying apparatus 200 according to Embodiment 2 of the present invention. The dehumidifying apparatus 200 will be described with reference to FIG. 15. A basic configuration of the dehumidifying apparatus 200 is the same as the configuration of the dehumidifying apparatus 100 according to Embodiment 1. In Embodiment 2, differences from Embodiment 1 will be mainly described. The same parts as those in Embodiment 1 are given the same reference numerals and their description will be omitted.

As illustrated in FIG. 15, the dehumidifying apparatus 200 includes a dehumidifying unit 1000 having an air passage housing 10A and a heat rejecting unit 2000 having an air passage housing 10B. The air passage housing 10A of the dehumidifying unit 1000 includes the first heat exchanger 11*a*, the moisture adsorbing unit 16, and the second heat exchanger 11*b*, and forms an airflow passage 10Aa through which air introduced by an air sending device 12Aa flows. The air passage housing 10B of the heat rejecting unit 2000 includes the third heat exchanger 11*c* and forms an airflow passage 10Ba through which air introduced by an air sending device 12Ab flows. That is, the air passage housing 10 described in Embodiment 1 is divided into two air passage housings, each of which forms an air passage.

The air passage housing 10A corresponds to "first air passage housing" of the present invention, and the air passage housing 10B corresponds to "second air passage housing" of the present invention.

Also, the air sending device 12Aa corresponds to "first an air sending device", and the air sending device 12Ab corresponds to "second an air sending device" of the present invention.

Specifically, in the dehumidifying unit 1000, air to be dehumidified is taken into the airflow passage 10Aa and passes through the first heat exchanger 11*a*, the moisture adsorbing unit 16, and the second heat exchanger 11*b* in this order to turn into dehumidified air, which is supplied to a space to be dehumidified. In the heat rejecting unit 2000, air to be dehumidified or air in another space is taken into the airflow passage 10Ba, passes through the third heat exchanger 11*c*, and is discharged from a space to be dehumidified.

The compressor 13, the expansion device 14, and the four-way valve 15 may be disposed in either of the dehumidifying unit 1000 and the heat rejecting unit 2000, and their locations are not limited. The sensor locations in the airflow passage of the dehumidifying apparatus, which are the same as those in Embodiment 1, the dehumidifying operation, the operation in the refrigerant circuit, and the system control method will not be described here.

<Effects of Invention>

As described above, the dehumidifying apparatus 200 is capable of discharging condensation heat from a space to be dehumidified, and suppressing a temperature rise in (or cooling) the space to be dehumidified. Therefore, in addition to achieving the effects provided by the dehumidifying apparatus 100 of Embodiment 1, the dehumidifying apparatus 200 can achieve substantial energy savings in a space which requires cooling and dehumidification (e.g., grain warehouse), as compared to a typical combination of a reheat dehumidifying apparatus and a cooling apparatus. Also, by controlling the air speed of the heat rejecting unit 2000, the dehumidifying apparatus 200 can control the amount of dehumidification of the dehumidifying unit 1000, and thus can easily achieve the amount of dehumidification suitable for the intended purpose.

The configuration of Embodiment 2 is applicable to other exemplary configurations described in Embodiment 1 (i.e., the exemplary configurations illustrated in FIGS. 12 and 13).

REFERENCE SIGNS LIST a: discharge temperature sensor, 1*b*: suction temperature sensor, 1*c*: temperature sensor, 1*d*: temperature sensor, 1*e*: temperature sensor, f: temperature sensor, 1*g*: temperature sensor, h: temperature sensor, 2*a*: temperature and humidity sensor, 2*b*: temperature and humidity sensor, 2*c*: temperature and humidity sensor, 2*d*: temperature and humidity sensor, 2*e*: temperature and humidity sensor, 3: air speed sensor, 4: counter, 5: control circuit, 10: air passage housing, 10A: air passage housing, 10Aa: airflow passage, 10B: air passage housing, 10Ba: airflow passage, 10*a*: airflow passage, 10*b*: air inlet, 10*c*: air outlet, 11*a*: first heat exchanger, 11*b*: second heat exchanger, 11*c*: third heat exchanger, 12: air sending device, 12Aa: air sending device, 12Ab: air sending device, 12*a*: air sending device, 12*b*: air sending device, 13: compressor, 14: expansion device, 15: four-way valve, 16: moisture adsorbing unit, 17: flow control device, 18*a*: opening and closing valve, 18*b*: opening and closing valve, 19*a*: air passage switching device, 19*b*: air passage switching device, 20: bypass, 100: dehumidifying apparatus, 101: refrigerant flow passage, 102*a*: refrigerant flow passage, 102*b*: refrigerant flow passage, 103: refrigerant flow passage, 104*a*: refrigerant flow passage, 104*b*: refrigerant flow passage, 200: dehumidifying apparatus, 200*a*: operation-mode changing control, 200*b*: operation-mode changing control, 200*c*: operation-mode changing control, 1000: dehumidifying unit, 2000: heat rejecting unit, A: refrigerant circuit

The invention claimed is:

1. A dehumidifying apparatus comprising:

at least one air passage housing having an air inlet and an air outlet;

a first heat exchanger disposed in the air passage housing;

a second heat exchanger disposed in the air passage housing;

a third heat exchanger disposed in the air passage housing;

a moisture adsorbing unit disposed between the first heat exchanger and the second heat exchanger in the air passage housing to desorb moisture to air with a low relative humidity and adsorb moisture from air with a high relative humidity;

an air sending device configured to send air to the first heat exchanger, the moisture adsorbing unit, the second heat exchanger, and the third heat exchanger in this order;

a compressor configured to compress refrigerant;

a bypass configured to allow the refrigerant discharged from the compressor configured to partially or entirely bypass the third heat exchanger;

a flow control device to control a flow rate of the refrigerant flowing through the bypass;

a first refrigerant circuit switching device to allow the first heat exchanger and the second heat exchanger to serve as a condenser and an evaporator, respectively, or allow the first heat exchanger and the second heat exchanger to serve as an evaporator and a condenser, respectively; and an expansion device configured to reduce a pressure of the refrigerant condensed by one of the first heat exchanger and the second heat exchanger, wherein the first refrigerant circuit switching device switches between a first refrigerant flow passage in which the refrigerant circulates through the compressor, the third heat exchanger, the second heat exchanger, the expansion device, and the first heat exchanger in this order and a second refrigerant flow passage in which the refrigerant circulates through the compressor, the third heat exchanger, the first heat exchanger, the expansion device, and the second heat exchanger in this order, and the flow control device controls a flow rate of the refrigerant flowing through the bypass, and controls an amount of heating in the third heat exchanger.

2. A dehumidifying apparatus comprising:

at least one air passage housing having an air inlet and an air outlet;

a first heat exchanger disposed in the air passage housing;

a second heat exchanger disposed in the air passage housing;

a third heat exchanger disposed in the air passage housing;

a moisture adsorbing unit disposed between the first heat exchanger and the second heat exchanger in the air passage housing to desorb moisture to air with a low relative humidity and adsorb moisture from air with a high relative humidity;

an air sending device configured to send air to the air passage housing;

a compressor configured to compress refrigerant;

a first refrigerant circuit switching device configured to allow the first heat exchanger and the second heat exchanger to serve as a condenser and an evaporator, respectively, or allow the first heat exchanger and the second heat exchanger to serve as an evaporator and a condenser, respectively; and an expansion device configured to reduce a pressure of the refrigerant condensed by one of the first heat exchanger and the second heat exchanger, wherein the air sending device is configured to send air to the first heat exchanger, the moisture adsorbing unit, and the second heat exchanger in this order, and an amount of heating in the third heat exchanger is controlled with one of the flow rate of the refrigerant flowing through the third heat exchanger and a volume of air passing through the third heat exchanger.

3. A dehumidifying apparatus comprising:

at least one air passage housing having an air inlet and an air outlet;

a first heat exchanger disposed in the air passage housing;

a second heat exchanger disposed in the air passage housing;

a third heat exchanger disposed in the air passage housing;

a moisture adsorbing unit disposed between the first heat exchanger and the second heat exchanger in the air passage housing to desorb moisture to air with a low relative humidity and adsorb moisture from air with a high relative humidity;

an air sending device configured to send air to the first heat exchanger, the moisture adsorbing unit, the second heat exchanger, and the third heat exchanger in this order;

an air passage switching device to switch a flow of air sent by the air sending device;

a compressor configured to compress refrigerant;

a flow control device to control a flow rate of the refrigerant discharged from the compressor and flowing through the third heat exchanger;

a first refrigerant circuit switching device to allow the first heat exchanger and the second heat exchanger to serve as a condenser and an evaporator, respectively, or allow the first heat exchanger and the second heat exchanger to serve as an evaporator and a condenser, respectively; and an expansion device configured to reduce a pressure of the refrigerant condensed by one of the first heat exchanger and the second heat exchanger, wherein the first refrigerant circuit switching device switches between a first refrigerant flow passage in which the refrigerant circulates through the compressor, the third heat exchanger, the second heat exchanger, the expansion device, and the first heat exchanger in this order and a second refrigerant flow passage in which the refrigerant circulates through the compressor, the third heat exchanger, the first heat exchanger, the expansion device, and the second heat exchanger in this order, and the air sending device and the air passage switching device control a volume of air passing through the third heat exchanger and control an amount of heating in the third heat exchanger.

4. The dehumidifying apparatus of claim 2, further comprising a flow control device to control a flow rate of the refrigerant discharged from the compressor and flowing through the third heat exchanger;

a second refrigerant circuit switching device to allow the refrigerant flowing out of the third heat exchanger to flow into the first heat exchanger or the second heat exchanger; and wherein the first refrigerant circuit switching device and the second refrigerant circuit switching device allow the third heat exchanger to be connected in parallel with one of the first heat exchanger and the second heat exchanger, and switch between a first refrigerant flow passage in which the refrigerant circulates through the compressor, the third heat exchanger, the second heat exchanger, the expansion device, and the first heat exchanger in this order and a second refrigerant flow passage in which the refrigerant circulates through the compressor, the third heat exchanger, the first heat exchanger, the expansion device, and the second heat exchanger in this order, and the flow control device controls the amount of heating in the third heat exchanger.

5. The dehumidifying apparatus of claim 2, further comprising:

a bypass configured to allow the refrigerant discharged from the compressor configured to partially or entirely bypass the third heat exchanger; and a flow control device to control a flow rate of the refrigerant flowing through the bypass;

wherein the air passage housing includes a first air passage housing and a second air passage housing, the air sending device includes a first air sending device and a second air sending device, the first heat exchanger is disposed in the first air passage housing, the second heat exchanger is disposed in the first air passage housing, the third heat exchanger is disposed in the second air passage housing, the first air sending device sends air to the first heat exchanger, the moisture adsorbing unit, and the second heat exchanger in this order, the second air sending device sends air to the third heat exchanger, the first refrigerant circuit switching device switches between a first refrigerant flow passage in which the refrigerant circulates through the compressor, the third heat exchanger, the second heat exchanger, the expansion device, and the first heat exchanger in this order and a second refrigerant flow passage in which the refrigerant circulates through the compressor, the third heat exchanger, the first heat exchanger, the expansion device, and the second heat exchanger in this order, and the flow control device controls a flow rate of the refrigerant flowing through the bypass, and controls the amount of heating in the third heat exchanger.

6. The dehumidifying apparatus of claim 5, further comprising:

a dehumidifying unit including the first air passage housing; and a heat rejecting unit including the second air passage housing, wherein in the dehumidifying unit, air taken from a space to be dehumidified into the first air passage housing is supplied to the space to be dehumidified; and in the heat rejecting unit, air taken from one of a space to be dehumidified and a space outside the space to be dehumidified into the second air passage housing is discharged to the space outside the space to be dehumidified.

7. The dehumidifying apparatus of claim 2, wherein the dehumidifying apparatus executes one of a first operation mode allowing the third heat exchanger, the second heat exchanger, and the first heat exchanger to serve as a condenser, a condenser, and an evaporator, respectively;

a second operation mode allowing the third heat exchanger, the second heat exchanger, and the first heat exchanger to serve as a condenser, an evaporator, and a condenser, respectively, and allowing the amount of heating in the third heat exchanger to be controlled;

a third operation mode allowing the third heat exchanger, the second heat exchanger, and the first heat exchanger to serve as a condenser, an evaporator, and a condenser, respectively; and a fourth operation mode allowing the third heat exchanger, the second heat exchanger, and the first heat exchanger to serve as a condenser, a condenser, and an evaporator, respectively, and allowing the amount of heating in the third heat exchanger to be controlled.

8. The dehumidifying apparatus of claim 7, wherein in a normal operation, an adsorption reaction and a desorption reaction of the moisture adsorbing unit are repeatedly executed by switching between the first operation mode and the third operation mode.

9. The dehumidifying apparatus of claim 8, wherein to make an amount of moisture desorbed by the desorption reaction of the moisture adsorbing unit greater than that in the normal operation, the adsorption reaction and the desorption reaction of the moisture adsorbing unit are repeatedly executed by switching between the first operation mode, the third operation mode, and the second operation mode.

10. The dehumidifying apparatus of claim 7, wherein in a defrosting operation of one of the first heat exchanger and the second heat exchanger, the moisture adsorbing unit executes an adsorption reaction in the first operation mode, defrosting of the first heat exchanger frosted in the first operation mode is executed in the second operation mode, the moisture adsorbing unit executes a desorption reaction in the third operation mode, defrosting of the second heat exchanger frosted in the third operation mode is executed in the fourth operation mode, and by switching between the first operation mode, the second operation mode, the third operation mode, and the fourth operation mode, the adsorption reaction and the desorption reaction of the moisture adsorbing unit are repeatedly executed and the defrosting of one of the first heat exchanger and the second heat exchanger is executed.

11. The dehumidifying apparatus of claim 2, wherein the moisture adsorbing unit includes an adsorbing material having at least one point where an amount of equilibrium adsorption at a relative humidity of 80% or more is greater than or equal to 1.5 times an amount of equilibrium adsorption at a relative humidity of 40% to 60%.

12. The dehumidifying apparatus of claim 2, wherein the moisture adsorbing unit is secured in a resting state in an airflow passage.

13. The dehumidifying apparatus of claim 2, wherein the moisture adsorbing unit is formed by a porous flat plate to allow air to pass therethrough in a thickness direction thereof.

14. The dehumidifying apparatus of claim 2, wherein the moisture adsorbing unit is located directly adjacent to both the first heat exchanger and the second heat exchanger in the air passage housing.

15. The dehumidifying apparatus of claim 2, wherein the moisture adsorbing unit is located directly downstream from the first heat exchanger and is located directly upstream from the second heat exchanger in the air passage housing.

* * * * *